US009988130B2

(12) United States Patent
Shin

(10) Patent No.: US 9,988,130 B2
(45) Date of Patent: Jun. 5, 2018

(54) HUMAN POWERED BOAT AND HUMAN-POWERED PROPULSION APPARATUS THEREFOR

(71) Applicant: Dynafeel Co., Ltd., Ansan-si, Gyeonggi-do (KR)

(72) Inventor: Bintz Shin, Ansan-si (KR)

(73) Assignee: Dynafeel Co., Ltd., Ansan-si, Gyeonggi-do (KR)

( * ) Notice: Subject to any disclaimer, the term of this patent is extended or adjusted under 35 U.S.C. 154(b) by 0 days. days.

(21) Appl. No.: 15/517,089

(22) PCT Filed: Oct. 6, 2015

(86) PCT No.: PCT/KR2015/010546
§ 371 (c)(1),
(2) Date: Apr. 5, 2017

(87) PCT Pub. No.: WO2016/056816
PCT Pub. Date: Apr. 14, 2016

(65) Prior Publication Data

US 2017/0305517 A1 Oct. 26, 2017

(30) Foreign Application Priority Data

Oct. 6, 2014 (KR) ..... 10-2014-0134083

(51) Int. Cl.
*B63H 1/36* (2006.01)
*B63B 7/08* (2006.01)
*B63B 7/00* (2006.01)

(52) U.S. Cl.
CPC ..... *B63H 1/36* (2013.01); *B63B 7/085* (2013.01); *B63B 2007/003* (2013.01); *B63B 2007/006* (2013.01)

(58) Field of Classification Search
CPC ..... B63H 1/30; B63H 1/36; B63H 2001/30; B63B 7/085; B63B 2007/003; B63B 2007/006
(Continued)

(56) References Cited

U.S. PATENT DOCUMENTS 227,491 A * 5/1880 Coulter ..... B63H 1/30 416/83
2,156,898 A * 5/1939 Lo Giudice ..... B63H 1/36 244/11
(Continued)

FOREIGN PATENT DOCUMENTS

JP 2007-186046 A 7/2007
KR 10-2003-0034774 A 5/2003
(Continued)

OTHER PUBLICATIONS

Robotic Design for SHOAL—Swimming mechanism [on-line], SHOAL Project Consortium, 2012 <accessed online at http://www.roboshoal.com/featured-items/robotic-design on Apr. 4, 2017>.
(Continued)

*Primary Examiner* — Daniel V Venne
(74) *Attorney, Agent, or Firm* — Novick, Kim & Lee, PLLC; Sang Ho Lee

(57) ABSTRACT

The present invention relates to a human-powered boat that a user can easily operate with his/her own manual power even though the boat is in a form causing large resistance to propulsion, and the human-powered boat is equipped with a propulsion apparatus that imitates the tail fin of a fish. The propulsion apparatus, in which an oscillating foil mechanism is applied to an "L-shaped oar", enables a rider to perform forward-facing rowing and can easily change a direction and prevent damage due to a collision with an underwater obstacle. Typically, the human-powered boat of the present invention has the following three limitations in
(Continued)

order to maximize simplicity while maintaining propulsion efficiency, compared with prior arts in the same technical field: First, a rider has a specific limitation in tilting the propulsion apparatus through an up-down movement of his/her arm. Second, the foil of the propulsion apparatus does not make contact with the longitudinal axis of the boat body in a predetermined range of motion. Third, the propulsion apparatus has a predetermined level of limitation in generating a propulsion force below the submerged portion of the boat body.

20 Claims, 17 Drawing Sheets

(58) Field of Classification Search
USPC ..... 440/101, 102, 103, 104, 105, 106, 107, 440/108, 109, 110, 13, 14, 15, 16, 17, 19, 440/20, 21, 22, 25, 32
See application file for complete search history.

(56) References Cited

U.S. PATENT DOCUMENTS 3,834,343 A * 9/1974 Hopkins ..... B63H 16/04 114/162
3,880,107 A * 4/1975 Miles ..... B63H 1/36 440/14
4,172,427 A * 10/1979 Kindred ..... B63B 35/73 403/233
4,345,903 A * 8/1982 Laser ..... B63B 35/73 114/140
4,642,056 A * 2/1987 Keivanjah ..... B63H 1/36 416/66
4,867,718 A 9/1989 duPont
4,867,719 A 9/1989 duPont
6,964,589 B1 11/2005 Lin
7,396,267 B1 7/2008 Parker
8,419,487 B2 4/2013 Parker

FOREIGN PATENT DOCUMENTS

KR 10-2011-0080696 A 7/2011
KR 10-2011-0083022 A 7/2011
KR 10-1328361 B1 11/2013

OTHER PUBLICATIONS

H. Yamaguchi et al., "Oscillating Foils for Marine Propulsion", The 4th International Society of Offshore and Polar Engineering Conference, vol. 3, 1994, pp. 539-544.

* cited by examiner

HUMAN POWERED BOAT AND HUMAN-POWERED PROPULSION APPARATUS THEREFOR

TECHNICAL FIELD

The present invention relates to a technical field of a boat moving by rowing oars that are taken out from left and right sides of the boat body. The boat is mostly compact and uses a non-motorized propulsion apparatus, i.e., human-powered propulsion apparatus as a propulsion apparatus thereof. Here, a rider may row oars through a forward and backward movement of rider's arms.

Particularly, the human-powered boat according to the present invention uses a human-powered propulsion apparatus having a mechanism that converts a forward and backward movement of a rider's arm into a left and right motion of a foil submerged under the water surface so that the boat moves while the rider faces the front that is an advancing direction of the boat.

BACKGROUND ART

The present invention is based on technical knowledge about 'forward-facing rowing' and 'oscillating foil' so as to safely secure a front view and improve energy efficiency of propulsion when a boat is propelled by using human power.

The most common example of the forward-facing rowing may be found in narrow beam boats having a sharp boat body such as a kayak or a canoe. However, in case of a wide beam boat having larger width, since a distance between its rider and the water surface outside the boat body is distant, a pivot may be positioned at a middle portion of each oar. Furthermore, since such a boat greatly undergoes propulsion resistance, the rider may generate propulsion force through a motion that pulls a handle of the oar backward than a motion that pushes the handle of the oar forward. The pulling motion may be converted in direction by the pivot, and thus, the boat may be accelerated in a direction opposite to the rider's eyes (backward-facing rowing).

Thus, in order to enable the rider to have a forward-facing rowing in the wide beam boat having the large width, additional ideas are necessary in addition to the installation of the pivot. The simplest solution of the ideas may be an "L-shaped oar", in which a middle portion of an oar's loom is bent. When the oar has a shape in which the oar extends from the handle in a width direction of the boat body to meet a side of the boat body and then extends backward in a longitudinal direction of the boat body so that the extending end is coupled to a plate-shaped foil, the forward and backward movement of the rider's arm may be converted into a left and right oscillating motion of the foil to generate propulsion force as if a fish moves a tail fin thereof.

The oscillating foil may be chosen as best technology in the above-described means that is capable of "generating the propulsion force like a fish" (see Robotic Design for SHOAL—Swimming mechanism [on-line], SHOAL Project Consortium, 2012.) Explaining a configuration and operation of a basic mechanism for realizing the oscillating foil mechanism with reference to FIG. 1, a first pivot 11 is disposed on a front end of an oscillating crank 32 having a predetermined length, and a plate-shaped foil 12 is coupled to a rear end of the oscillating crank 32 to allow the oscillating crank 32 to oscillate about the first pivot 11. As a result, the foil 12 pushes water backward to generate propulsion force F.

In addition to these basic components, a second pivot 13 is additionally disposed on a front portion of the foil 12 to allow the foil 12 to relatively rotate with respect to the oscillating crank 32, thereby more improving propulsion efficiency. Explaining a specific operation principle, when rotating force is applied to the first pivot 11 in a counterclockwise direction in the idle state of the oscillating crank, the foil 12 rotates about the second pivot 13 in a clockwise direction while largely moving along a rear end of the oscillating crank 32 and then is stopped at a limited angle $\beta$. Thereafter, the foil 12 obliquely pushes water until the oscillating crank 32 reaches a limited angle $\alpha$.

When the oscillating crank 32 switches its direction to start the rotation again in the clockwise direction, the foil 12 rotates in a counterclockwise direction and stops at a limited angle. Then, the foil 12 pushes water until the oscillating crank 32 reaches the limited angle.

That is, the foil 12 primarily largely oscillates about the first pivot 11, and simultaneously, secondarily flaps in small about the second pivot 13 to generate the propulsion force F.

Here, it is preferable that the first pivot 11 and the second pivot 13 provide rotation axes that are perpendicular to the water surface to prevent the boat body from pitching due to the oscillation of the foil 12.

According to the advanced researches about an oscillating foil propulsion mechanism, propulsion efficiency can be increased by making the end portion of the foil 12 flexible. (see H. Yamaguchi et al., "Oscillating Foils for Marine Propulsion", The 4th International Society of Offshore and Polar Engineering Conference, vol. 3, 1994, pp. 539-544.)

Hereinafter, the prior arts, which are combinations of above-mentioned L-shaped oar and the oscillating foil mechanism, will be introduced using the above-mentioned terms.

The most impressive technology is U.S. Pat. No. 4,867,718 (1989 Sep. 19) to Stephen Dupont. Characteristically, two hinges, a 'sweep hinge' that corresponds to the first pivot by providing a vertical rotation axis at the bent part of L-shaped oars and a 'teeter hinge' that has a horizontal rotation axis, are coupled simultaneously and the two hinges may be involved in the entire movement of the oar at the same time. Here, in a coupling structure between the oscillating crank and the foil, the position of the second pivot is retreated toward a central portion of the foil, not to the front end of the foil. By doing this, it has the effect of accelerating the secondary flapping motion of the foil. U.S. Pat. No. 4,867,719 (1989 Sep. 19) filed by the same inventor discloses a feature in which a sliding outrigger is added to the components of the foregoing invention.

Thereafter, according to U.S. Pat. No. 6,964,589 (2005 Nov. 15) by Roger Lin, by transmitting the rider's arm movement to a rear side of a boat body using a power transmission device, the foil can perform flapping motion without colliding with the boat body even without an outrigger. In addition, the oscillating crank is obliquely dropped from a position higher than the water surface of the stern to minimize its submerging portion.

Thereafter, Jack Parker introduced the most simplified mechanism that is imaginable in corresponding technical fields by coupling the foil directly to the first pivot through U.S. Pat. No. 7,396,267 (2008 Jul. 8). U.S. Pat. No. 8,419,487 (2013 Apr. 16) filed by the same inventor discloses a feature in which the first pivot is moved from the inside to the outside of the boat body.

SUMMARY OF INVENTION

Technical Problem

An objective of the present invention is to provide a propulsion apparatus having the most simplified structure while maintaining propulsion efficiency of oscillating foil.

When disadvantages of the foregoing prior arts are discovered based on this objective and 'adoption of ideas' or 'omission of ideas' which becomes the cause of the disadvantages are analyzed and summarized, resultant features may be described as follows.

In U.S. Pat. Nos. 4,867,718 and 4,867,719, a 'teeter hinge' is adopted for fixing an L-shaped oar, so the complexity of the propulsion apparatus increases, and simultaneously, a rotation axis of a foil cannot be vertically fixed with respect to the water surface while a boat moves, so the boat body tends to move up and down according to rider's arm movement and finally the propulsion efficiency decreases as a result. However, since the 'teeter hinge' enables a rider to lift the foil and load it on the boat as a boat using a general oar collects a row at anchor, if this retracting function is desired, the teeter hinge may be an idea that cannot be omitted.

In U.S. Pat. No. 6,964,589, a power transmission device is adopted for transmitting the rider's arm movement to an oscillating crank that is positioned at a rear portion of the boat body, so the complexity of the propulsion apparatus increases. However, since the foil is positioned behind a stern, a space in which the foil oscillates is secured without using an outrigger as its advantage.

In U.S. Pat. Nos. 7,396,267 and 8,419,487, a foil is directly coupled to the first pivot in a state which the oscillating crank is omitted in the propulsion apparatus. Since the essential components for securing effectiveness of oscillating foil mechanism is not prepared, it may be difficult to expect higher propulsion efficiency. However, in the propulsion apparatus according to the inventions, the foil can rotate at an angle of 180 degrees to generate reverse propulsion force through the same arm movement as the former arm movement (this function enables the rider to perform the forward-facing rowing and the backward-facing rowing). For this, the foil is positioned under a keel of the boat body. If an oscillating crank is added to a front portion of the foil positioned in the deep water, big resistance may occur when rowing.

The problems involved in the prior arts as described above may occur by intentionally adopting or omitting a specific component in order to obtain a desirable expected effect from different perspectives. Thus, an approach for a new invention by adding a component of one prior art to another prior art cannot be effective. Thus, the geometry and mechanism of the propulsion apparatus has to be totally redesigned.

The objective of the present invention is specifically described as follows:

① forward-facing rowing of a rider

② high-efficient propulsion apparatus having a simplified structure

③ securing a space for a foil's oscillation on a side of a boat body

④ enabling the rider to perform oval arm movement

⑤ preventing a foil from being damaged by an underwater obstacle

⑥ easy detachment of the propulsion apparatus from the boat body

⑦ structure of the foil for reducing manufacturing costs

Solution to Problem

To solve the foregoing problems, the present invention proposes a new solution that indirectly secures some advantages of the prior arts and resolutely abandons some preferable functions of them by totally redesigning the geometry and mechanism of the propulsion apparatus in which the oscillating foil mechanism is applied to the L-shaped oar.

Particularly, a human-powered boat according to the present invention, which is capable of being propelled by rider's power and constituted by following units including a boat body having a predetermined length and width, at least one mounting means provided at a position that is away by a predetermined distance from a longitudinal axis of the boat body to at least one outside of left and right sides, and at least one propulsion apparatus coupled to the mounting means to operate by a rider's arm, wherein the mounting means provides a first rotation axis in a vertical direction.

Each of the propulsion apparatuses includes a rotational post fixed in position by the mounting means to rotate about the first rotation axis, a handle crank having a predetermined length and placed in a width direction of the boat body so that an outer end thereof is coupled to an upper portion of the rotational post, an oscillating crank having a predetermined length and placed in a longitudinal direction of the boat body so that a front end thereof is coupled to the rotational post, and a rear end thereof has a height less than that of the outer end of the handle crank, and a plate-shaped foil having a predetermined length and height and coupled to the rear end of the oscillating crank in a longitudinal direction of the boat body.

Thus, when the rider grasps the handle crank to alternately move forward and backward, the foil may oscillate in a left and right direction about the first rotation axis to generate propulsion force.

Here, in order to maximize the simplicity of the apparatus while maintaining propulsion efficiency, the human-powered boat according to the present invention includes following three limitations.

① If the first rotation axis is not tilted, the oscillating crank is not tilted through the vertical movement of the rider's arm.

② A motion range of the foil does not reach the longitudinal axis of the boat body.

③ The generation of the propulsion force under the portion of the boat body submerged in the water is limited to a predetermined level.

In addition to the above constituents, in the human-powered boat according to the present invention, the oscillating crank may be spread at an angle of 5 degrees or more in its top plan view to the outside of the boat body to increase the motion range of the foil.

Also, in order to effectively apply the knowledge of oscillating foil mechanism, a flapping hinge having a rotation axis in the vertical direction may be coupled to the rear end of the oscillating crank, and the foil may be coupled to the flapping hinge in a longitudinal direction of the boat body, wherein since the foil horizontally rotates at a predetermined angle about the rotation axis provided by the flapping hinge, the foil may have a specific pitch in generating propulsion force. Here, when a side surface of the foil is divided into two front and rear portions by a virtual vertical center line, the rear portion may be more flexible than the front portion.

Advantageous Effects of Invention

In the human-powered boat according to the present invention, the L-shaped propulsion apparatus may be basically used to allow the rider to row in the moving direction of the boat (the rider rows facing forward), thereby giving the psychological stability to the rider.

The unnecessary additional ideas may be eliminated to provide the propulsion apparatus having the maximally simplified structure while maintaining the high-efficient propulsion property of the oscillating foil mechanism. This may provide the effects of the easy handling and reduced manufacturing costs.

Also, the motion range for generating the propulsion force at a side of the boat body may be sufficiently secured without using an outrigger to reduce the manufacturing costs and the overall width of the human-powered boat, thereby allowing the boat to be used in the crowded aquatic environments such as the public swimming pool.

The rider may operate the propulsion apparatus through his/her arm movement freely without being aware of whether the propulsion apparatus is tilted or not, and also, the propulsion apparatus may be easily detached from or mounted on the boat body.

A means for protecting the propulsion apparatus when colliding with the underwater obstacle may be prepared.

Since the foil of the propulsion apparatus has the structure having a vertical rotation axis by itself, the injection molding may be easy, and the manufacturing costs may be reduced.

DESCRIPTION OF EMBODIMENTS

Embodiments of the present invention will now be described with reference to the accompanying drawings.

The present invention relates to a propulsion apparatus to which an oscillating foil mechanism is applied to an 'L-shaped oar' and a boat that obtains propulsion force by using the same. The L-shaped oar means an oar having a 'loom that is bent in an L shape' in the whole outer appearance in a top plan view. This L-shaped oar may convert rider's forward and backward arm movement that is inputted to one end of the oar into a left and right motion of the other end when setting the boat's sailing direction forward.

Figure 1:
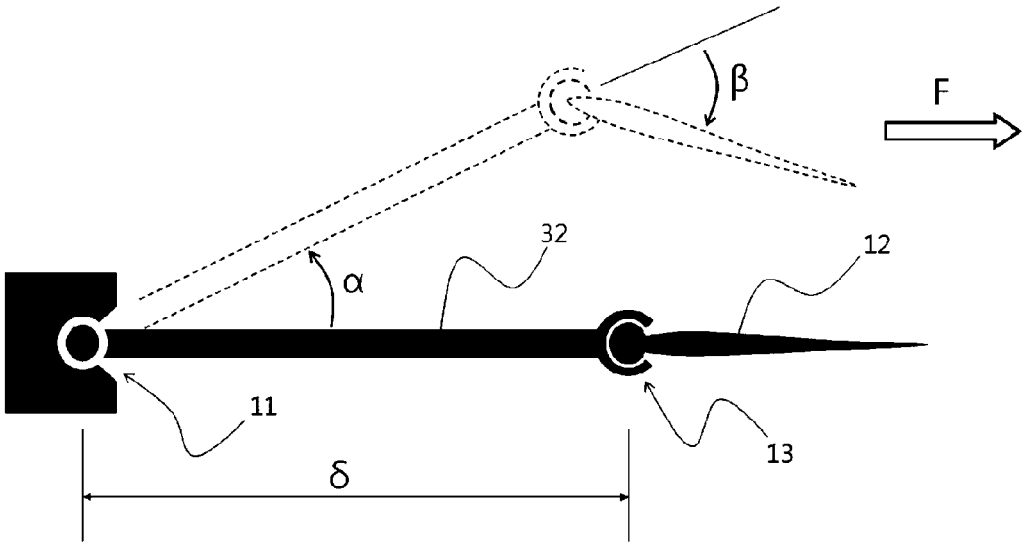
FIG. 1 is a view illustrating a basic configuration and operation of an oscillating foil mechanism.
Figure 2A:
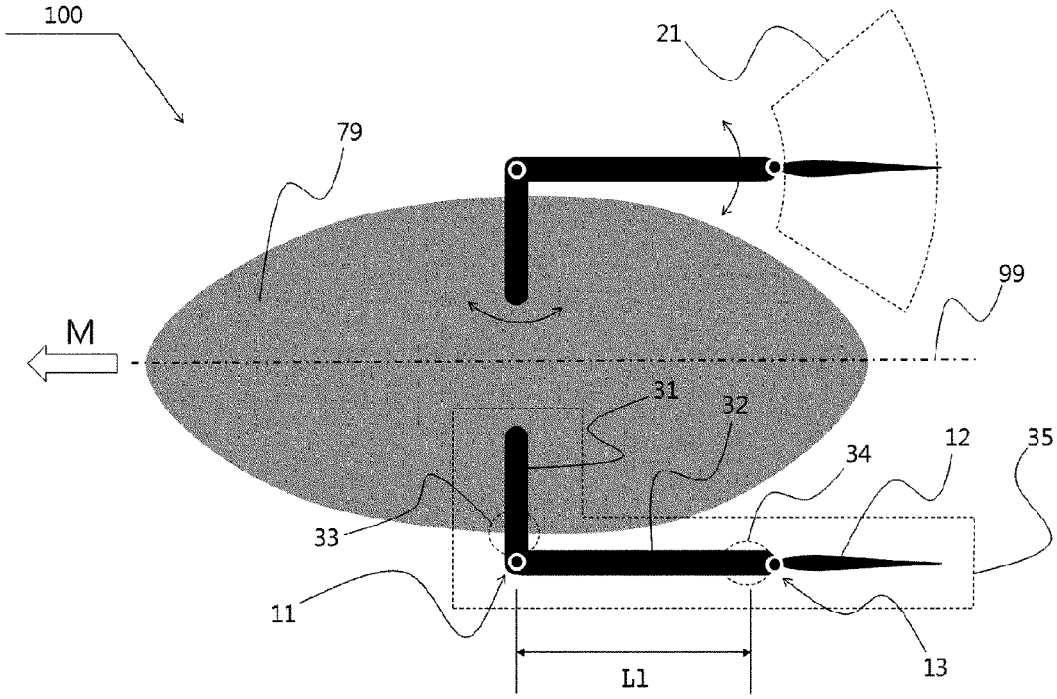
FIGS. 2A to 2C are views illustrating a human-powered propulsion apparatus and a geometry and mechanism of a human-powered boat using the same according to the present invention.

FIG. 2A is a schematic top plan view illustrating a human-powered propulsion apparatus and a geometry and mechanism of a human-powered boat using the same according to the present invention. A human-powered boat 100, according to the present invention, has a structure in which two L-shaped propulsion apparatuses 35 are mounted bilaterally symmetric to each other with respect to a longitudinal axis 99 of a boat body 79 having a predetermined length and width and moving forward (M). In the present invention, a human-powered boat 100 may be a boat in a dictionary definition that is a small ship designed to be able to float while moving on water as well as a board concept including an inflatable float having various shapes in which a person rides thereon on water. In addition, it is preferable that the boat body 79 constituting the human-powered boat 100 of the present invention includes an inflatable float on at least one side of both sides thereof or the boat body is an inflatable float in itself but is not limited thereto. In detailed descriptions with respect to the position and configuration of the propulsion apparatus 35, a first pivot 11 is positioned away by a predetermined distance outward from a longitudinal axis 99 of the boat body 79, and the propulsion apparatus 35 oscillates about the first pivot 11. Here, a potion at which a handle crank 31 and an oscillating crank 32, which serve as an oar's loom in the propulsion apparatus 35, meet approximately perpendicular to each other and then coupled to each other is fixed to the boat body 79 by the first pivot 11.

As illustrated in the drawings, the handle crank 31 has a predetermined length and is placed in a width direction of the boat body 79 so that an outer end 33 thereof is coupled to the first pivot 11, and the oscillating crank 32 has a predetermined length and is placed in a longitudinal direction of the boat body 79 so that a front end thereof is coupled to the first pivot 11. Here, it is preferable that the handle crank 31 and the oscillating crank 32 are coupled to each other at an angle that is approximately perpendicular to each other, but the angle may be adjusted according to a position of the rider or a structure of the boat body 79.

In addition, a plate-shaped foil 12 having a length and height is coupled to a rear end 34 of the oscillating crank 32 in a longitudinal direction of the boat body 79. When the rider seats behind the handle crank 31 and grips it by hand and then alternately move the handle crank 31 forward and backward, the foil 12 may oscillate in a left and right direction about the first pivot 11 to generate propulsion force. This operation may correspond to forward-facing rowing in which the rider faces an advancing direction of the boat body 79 and moves the boat.

Here, the propulsion apparatus 35 is illustrated in a state in which the oscillation is stopped at an angle at which propulsion resistance with respect to a flow of the water in a longitudinal direction of the boat body 79 is smallest and this state may be defined as an idle state in the present invention.

To improve efficiency of the propulsion apparatus 35 according to the oscillating foil mechanism that is described above under the title of background, it is preferable that a second pivot 13 is added to a portion at which the oscillating crank 32 and the foil are coupled to each other. Here, the second pivot 13 may allow the propulsion apparatus 35 to have a specific pitch in generating the propulsion force, like a propeller, and the foil 12 may complexly oscillate about the first pivot 11 and the second pivot 13.

In the present invention, when a maximal oscillation is performed having the same left and right angle with respect to the idle state of the oscillating crank 32 to generate the propulsion force, an area on which the foil 12 is swept on a virtual plane that is parallel to the water surface and cuts a center of the foil 12 may be defined as a maximum motion range 21. In the drawing, the area is expressed on portions of the propulsion apparatus 35, which are symmetrically opposed to each other, due to spatial restraint.

Figure 2B:
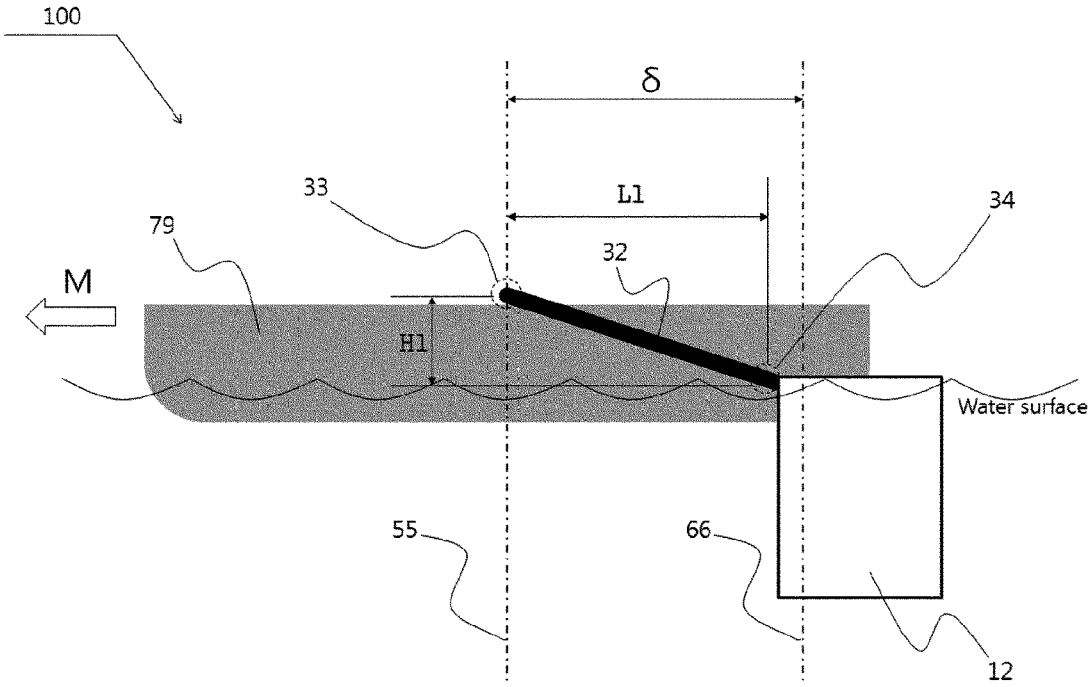

FIG. 2B is a schematic front view of the human-powered boat 100 illustrated in FIG. 2A. FIG. 2B illustrates a left side of the boat body 79. Since the outer end 33 of the handle crank 31 is positioned in a higher portion of the boat body 79, and the rear end 34 of the oscillating crank 32 is positioned in a lower portion of the boat body 79, it is confirmed that a height difference H1 is clearly generated between the outer end 33 and the rear end 34. Further, the rear end 34 of the oscillating crank 32 is positioned higher than the lowest portion of the boat body 79.

A reason in which a distance 6 from a first rotation axis 55 provided by the first pivot 11 to a second rotation axis 66 provided by the second pivot 13 is greater than a straight-line distance L1 from the first rotation axis 55 to the rear end 34 of the oscillating crank 32 in a longitudinal direction of the boat body 79 is for representing the technical knowledge in which the propulsion efficiency of the oscillating foil is improved when the second pivot 13 (or the second rotation axis 66) is positioned backward from a front portion of the foil 12 with somewhat space.

Furthermore, it is preferable that the foil 12 has a height greater than a length thereof to form a shape that is elongated downward on the whole. This shape may improve the propulsion efficiency by quickly performing a flapping motion of the foil 12 together with the second rotation axis 66 moved backward.

The above-described human-powered boat and human-powered propulsion apparatus may have three functional limitations in operation thereof.

First, since the oscillating crank 32 oscillates about only the first rotation axis 55, it is impossible to tilt the oscillating crank 32 through the vertical movement of the rider's arm during movement. Thus, it is difficult to adjust a depth, to which the foil is submerged in the water, by the rider as if a general oar is used.

Second, since a range in which the oscillating crank moves without contacting the boat body 79, is limited under a configuration that the first pivot 11 providing a center about which the propulsion apparatus oscillates is positioned on a side of the boat body 79, it is difficult to allow the foil 12 to pass through the longitudinal axis of the boat body 79. Accordingly, it is not effective to turn the angle of the foil 12 and use it as a rudder.

Third, there is a limitation in moving the foil 12 under the submerged portion of the boat body 79 since the rear end of the oscillating crank 32 is positioned higher than the lowest portion of the boat body 79. It is impossible to turn the foil 12 under the boat body 79 so as to convert the propulsion direction.

Figure 2C:
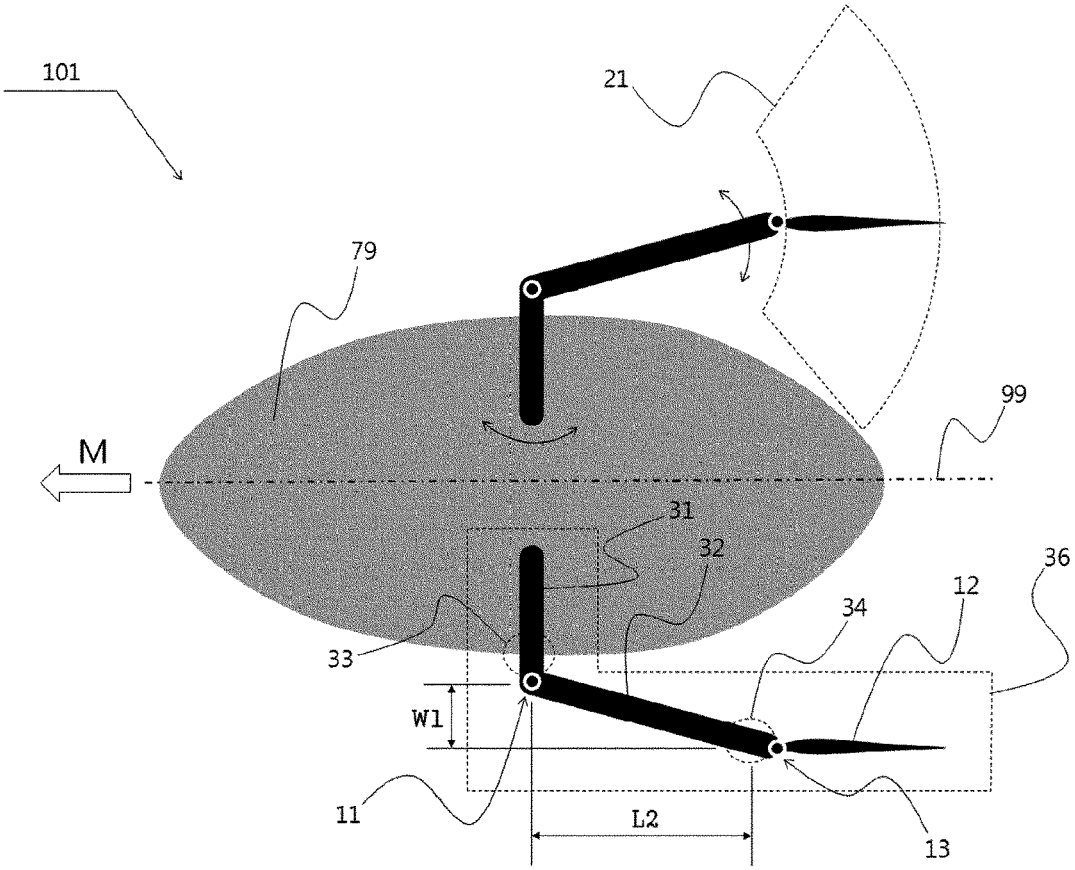

In the human-powered boat 101 illustrated in FIG. 2C, the propulsion apparatus 36 having an improved structure in which the oscillating crank 32 is spread outward to increase the motion range 21 of the foil 12 is mounted. This improvement may provide an economical effect, in which the motion range 21 is expanded, by locating the foil 12 of the propulsion apparatus farther away outward from the longitudinal axis 99 of the boat body 79, without moving the fixed position of the first pivot 11 outward by adding an outrigger on the boat body 79.

Here, it is preferable that a ratio of a straight-line distance W1 in a width direction of the boat body 79 to a straight-line distance L2 in a longitudinal direction of the boat body 79 from the first pivot 11 to the end 34 of the oscillating crank has an arc tangent of 5 degrees or more.

Figure 2D:
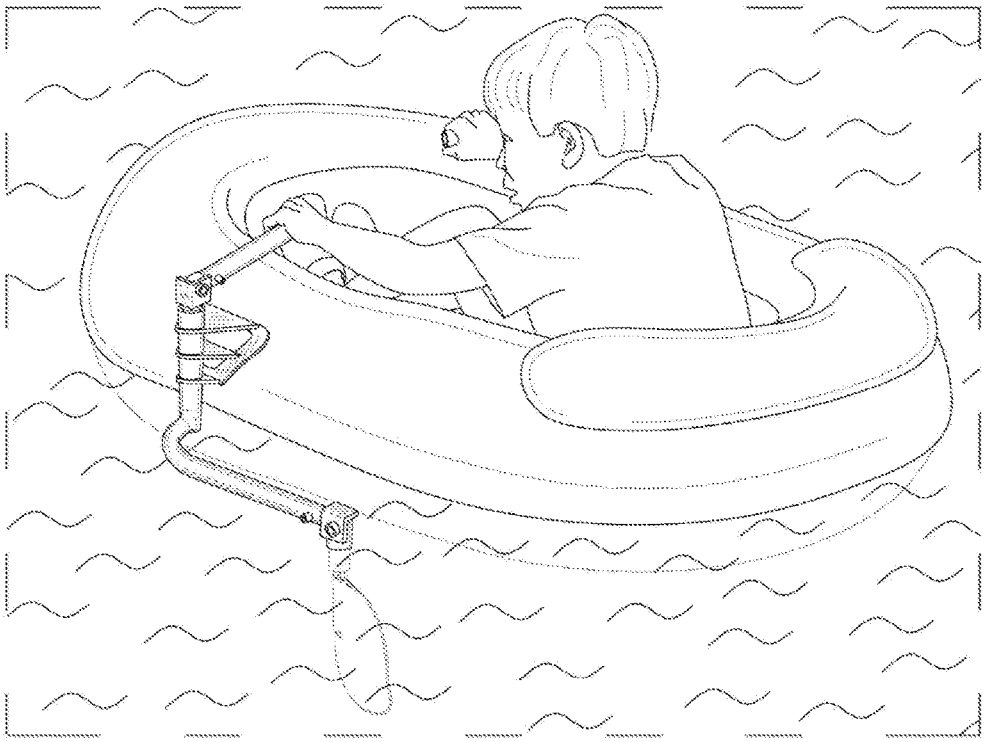
FIG. 2D is a photograph of a state in which a working demonstrator of the human-powered boat illustrated in FIG. 2C is prepared to give a demonstration according to a first embodiment of the present invention.

FIG. 2D is a photograph of a state in which a working demonstrator of the human-powered boat is prepared to give a demonstration according to a first embodiment of the present invention in which various functions are added and embodied while maintaining the geometry and mechanism of the human-powered boat 101 in the top plan view illustrated in FIG. 2C.

According to results of a performance test, the human-powered boat may move at a speed that is greater than a walking speed despite the rider is a child having weak physical strength and the boat causes large propulsion resistance. It is also confirmed that previous education or practice is unnecessary when the propulsion apparatus 36 is initially used, and a reverse propulsion function is unnecessary because the boat is easily changed in direction. This may be impossible or very difficult in case where a child rows a general oar.

The results of the performance test confirm that various functional limitations do not have significant effect on product value due to maximally simplified structure. Therefore, the human-powered boat and the human-powered propulsion apparatus according to the present invention may take the above-described embodied functional limitations as technical features of the present invention.

The functional limitations of the human-powered boat and the human-powered propulsion apparatus according to the present invention will be described in detail as follows with reference to FIGS. 2A to 2C.

First, it is impossible to tilt the oscillating crank 32 through the vertical movement of the rider's arm without tilting the first rotation axis 55. This may limit a motion form of the oscillating crank 32 during movement, and thus, the allowable motion may only be the oscillation about the first rotation axis 55.

Thus, since an erroneous operation of the rider (erroneous arm operation) during movement does not cause a tilting of the oscillating crank 32 (about a center line in a longitudinal direction of the boat body 79 or a center line in a width direction of the boat body 79), the propulsion force of the foil 12 may be generated in the uniform direction to improve the propulsion efficiency. At the same time, the rider may move freely without having a concern of the mistake thereof.

Second, the maximum motion range 21 of the foil 12 does not cross the longitudinal axis 99 of the boat body 79. Thus, the function of each of the propulsion apparatuses 35 and 36 as a static rudder may be limited. However, since the propulsion apparatus according to the present invention generates the propulsion force on the side of the boat body 79, the direction change may be enabled by causing a difference in left and right propulsion forces of the boat body 79. As a result, a dynamic rudder function is maintained as ever.

Third, when the maximum motion range 21 of the foil 12 and 'the area of the boat body submerged in the water (a plane of draft)' are vertically projected onto the same virtual horizontal plane, the portion overlapped by each other may be less than 30% of the total area of the maximum motion range 21. Thus, the range in which the propulsion force is generated may be limited in size. Here, a smaller overlapping portion is preferable, but the size percentage of overlapped portion is set under consideration of a change in draft according to loaded weight.

In the second and third functions, each of the propulsion apparatuses is limited in size and capacity. If the propulsion apparatus mounted on the side of the boat body 79 operates to cross the longitudinal axis 99 of the boat body 79, the oscillating crank 32 may be elongated, or a power transmission device may be added thereby increasing a size of the propulsion apparatus. Therefore, this functional limitation may be necessary to simplify the propulsion apparatus. Since it has a clear limitation to improve the propulsion efficiency by increasing the maximum motion range of the foil 12 under the condition in which the limited human power is used as input power, this limitation may be preferable in consideration of the 'scale efficiency'.

Also, if the propulsion apparatus widely operates under the area of the boat body 79 that is submerged in the water, the portion of the oscillating crank 32, which is submerged in the water increases (because the depth of the boat body 79 generally increases in cross-section toward a middle portion thereof) thereby causing unnecessary propulsion resistance. Thus, this limitation may act as a direct pulse effect in improving of the propulsion efficiency.

As described above, the present invention adopts the three functional limitations to maximize the simplicity of the apparatus while maintaining the propulsion efficiency and obtain the reflective improvement in performance from each of the limitations. At a word, removing unnecessary ideas may improve the values of products.

The human-powered boat according to the first embodiment 101 of the present invention will be described in detail with reference to FIGS. 3A to 3C.

Figure 3A:
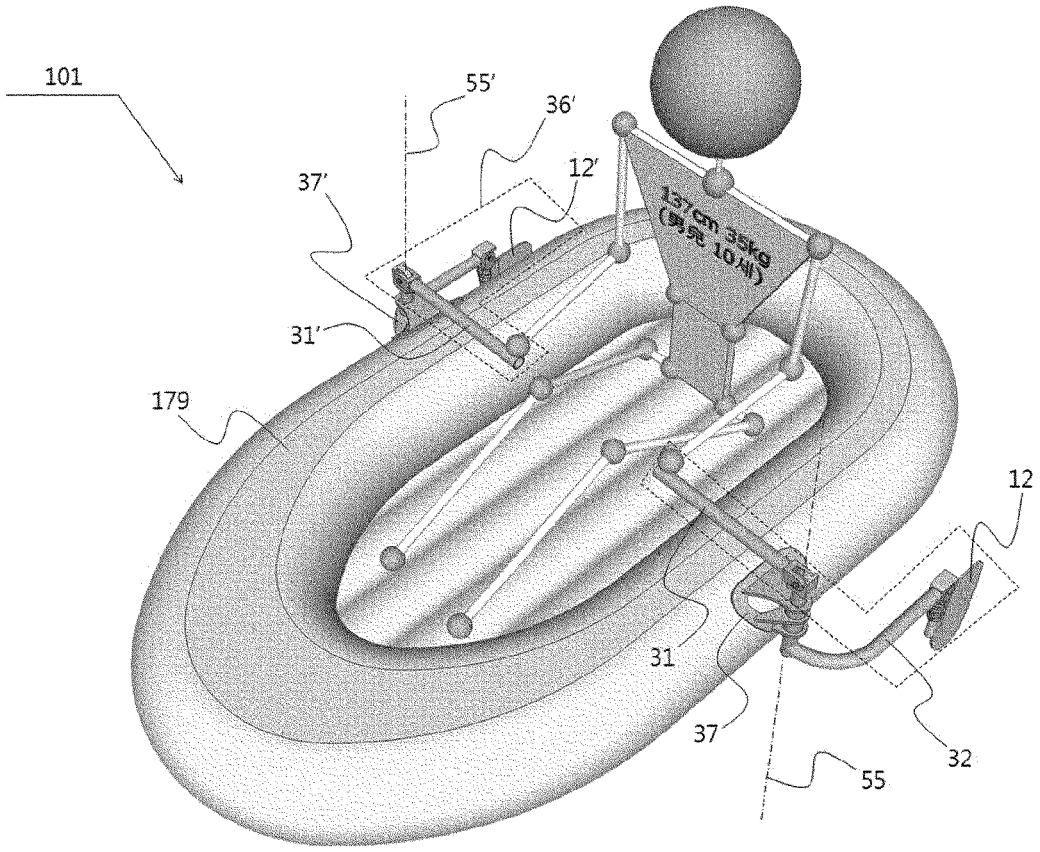
FIGS. 3A to 3C are views of the human-powered boat according to the first embodiment of the present invention.
Figure 3B:
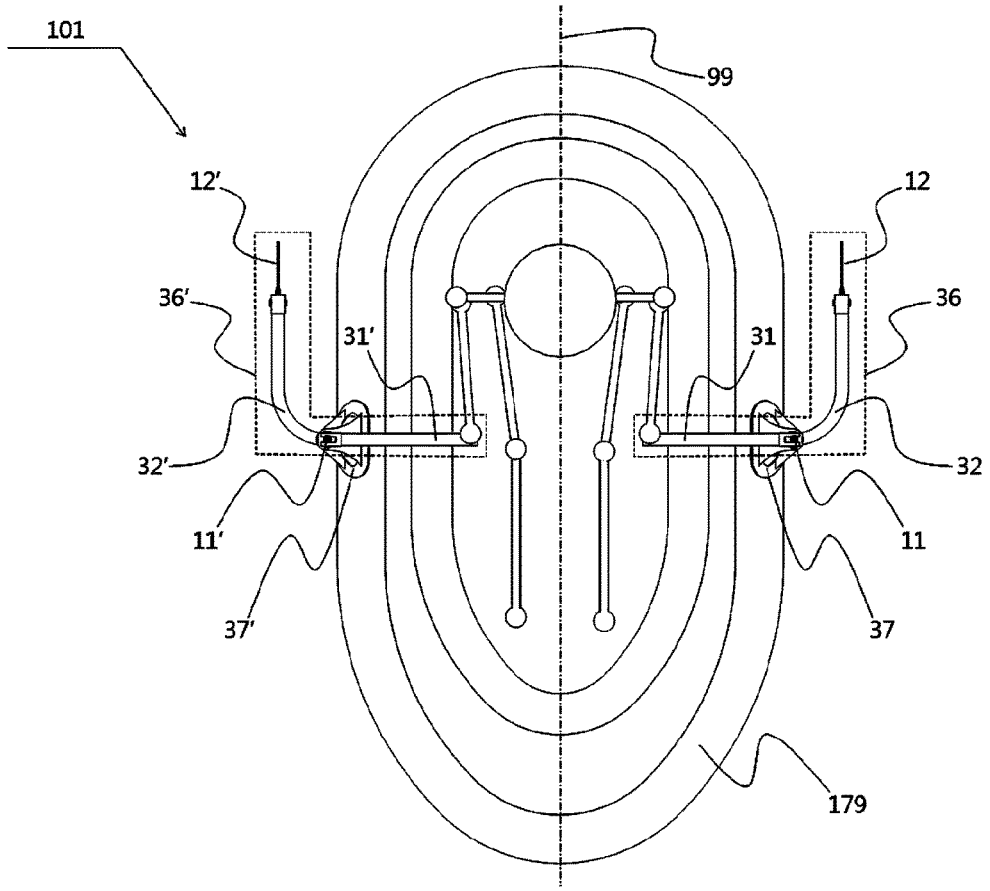

Referring to the perspective view of FIG. 3A and the top plan view of FIG. 3B, the human-powered boat 101 according to the present invention has a structure in which two L-shaped propulsion apparatuses 36 and 36' are mounted on an inflatable boat body 179 having a predetermined length and width and moving forward, and bilaterally symmetrical to each other with respect to the longitudinal axis 99 of the boat body 179. Each of the propulsion apparatuses 36 and 36' illustrated in FIG. 3B is in an idle state.

In detailed description of position and configuration of the propulsion apparatuses 36 and 36', mounting means 37 and 37' may be coupled to positions that are away by a predetermined distance outward from the longitudinal axis 99 to left and right sides of the boat body 179, and the propulsion apparatuses 36 and 36' each of which has an L-shaped oar are respectively coupled to the mounting means 37 and 37'. Here, the mounting means 37 and 37' may provide first pivots 11 and 11' to the propulsion apparatuses 36 and 36' coupled thereto, respectively. Thus, the propulsion apparatuses 36 and 36' may overall oscillate about the first pivots 11 and 11', respectively.

Oars' looms, which determine the whole shapes of the propulsion apparatuses in FIG. 3B, may be formed by coupling handle cranks 31 and 31' to oscillating cranks 32 and 32'. It is seen that the first pivots 11 and 11' are positioned on places at which the handle cranks 31 and 31' and the oscillating cranks 32 and 32' meet to be coupled to each other. Each of the handle cranks 31 and 31' has a predetermined length and is placed in a width direction of the boat body 179 so that an outer end thereof is coupled to each of the first pivots 11 and 11'. Also, each of the oscillating cranks 32 and 32' has a predetermined length and is placed in a longitudinal direction of the boat body 179 so that a front end thereof is coupled to each of the first pivots 11 and 11'.

Here, it is preferable that each of the handle cranks 31 and 31' and each of the oscillating cranks 32 and 32' are coupled to each other at an angle that is approximately perpendicular to each other. However, the angle may be adjusted according to a position of the rider or a structure of the boat body 179.

Also, each of plate-shaped foils 12 and 12', each of which has a length and height, is coupled to a rear end of each of the oscillating cranks 32 and 32' in a longitudinal direction of the boat body 179. When the rider seats behind the handle cranks 31 and 31' and grips them by hands and then alternately move the handle cranks 31 and 31' forward and backward, the foils 12 and 12' may oscillate in a left and right direction about each of the first pivots 11 and 11' to generate propulsion force. This operation may correspond to forward-facing rowing in which the rider faces an advancing direction of the boat body 179 and moves the boat.

Figure 3C:
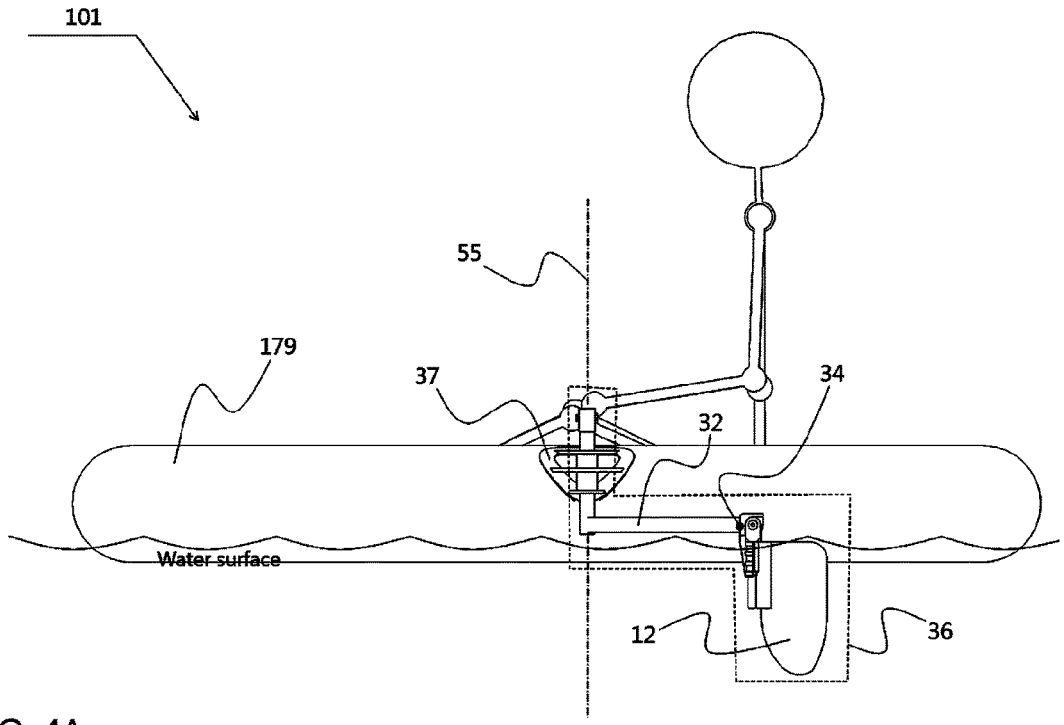

FIG. 3C illustrates a right side view of the human-powered boat according to the first embodiment of the present invention. Here, the handle crank 31 is positioned above the mounting means 37, and the oscillating crank 32 is positioned below the mounting means 37. As shown in the drawing, it is preferable that the oscillating crank 32 is positioned above the water surface and thus does not contact the water surface during the operation, and the whole of the foil 12 may be submerged under the water surface if possible.

The human-powered propulsion apparatus according to the present invention may represent a combination of the mounting means and the propulsion apparatus.

Figure 4A:
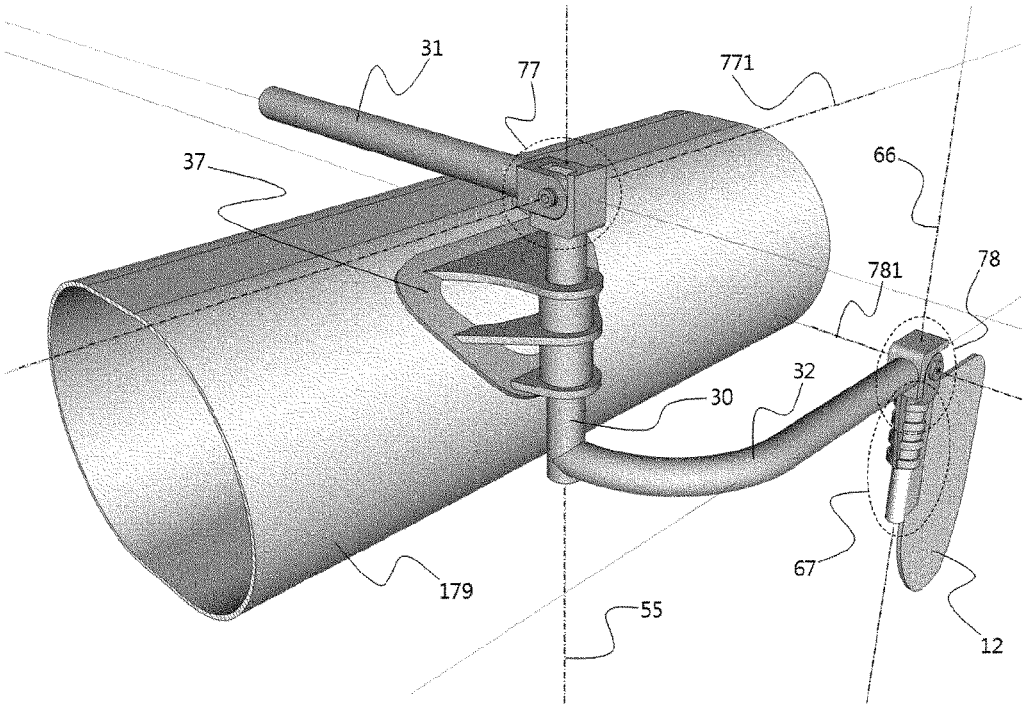
FIGS. 4A to 4C are views of a human-powdered propulsion apparatus of FIG. 3A according to the first embodiment of the present invention.
Figure 4B:
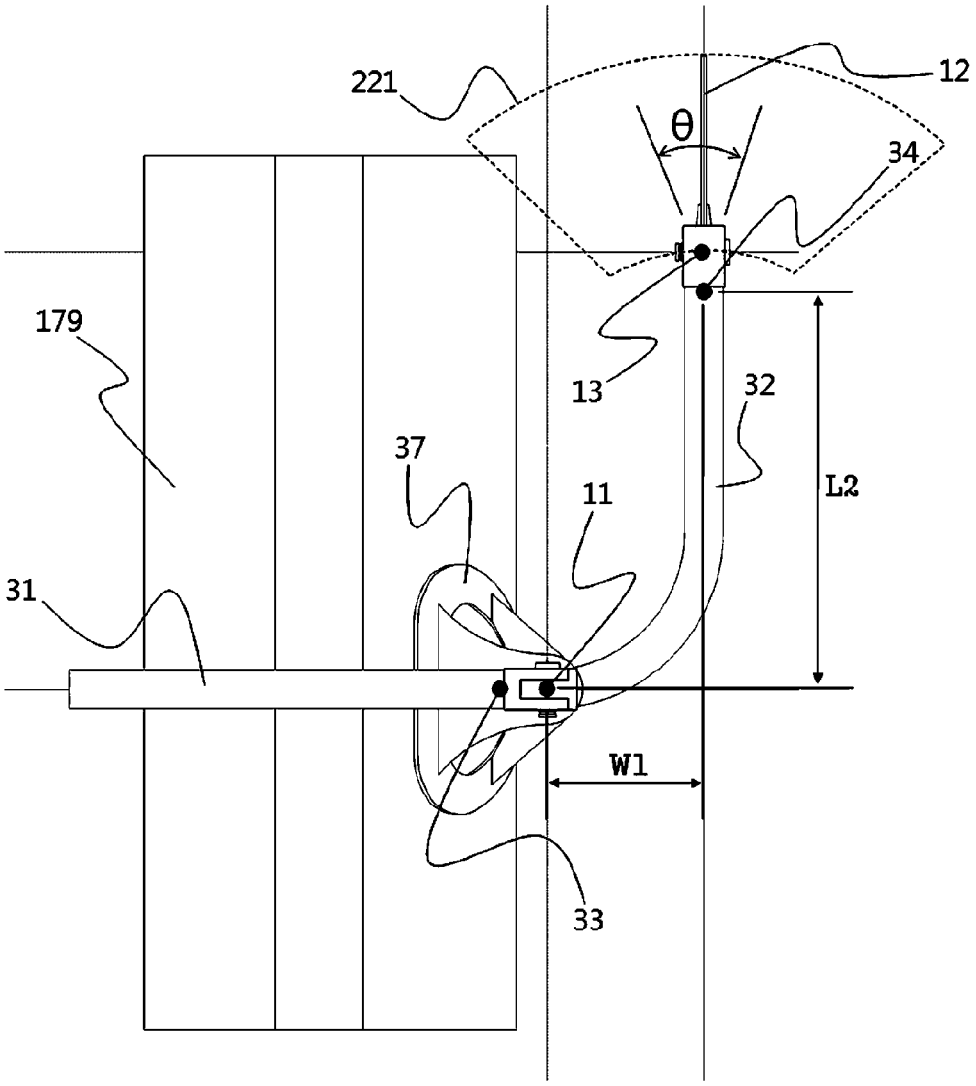
Figure 4C:
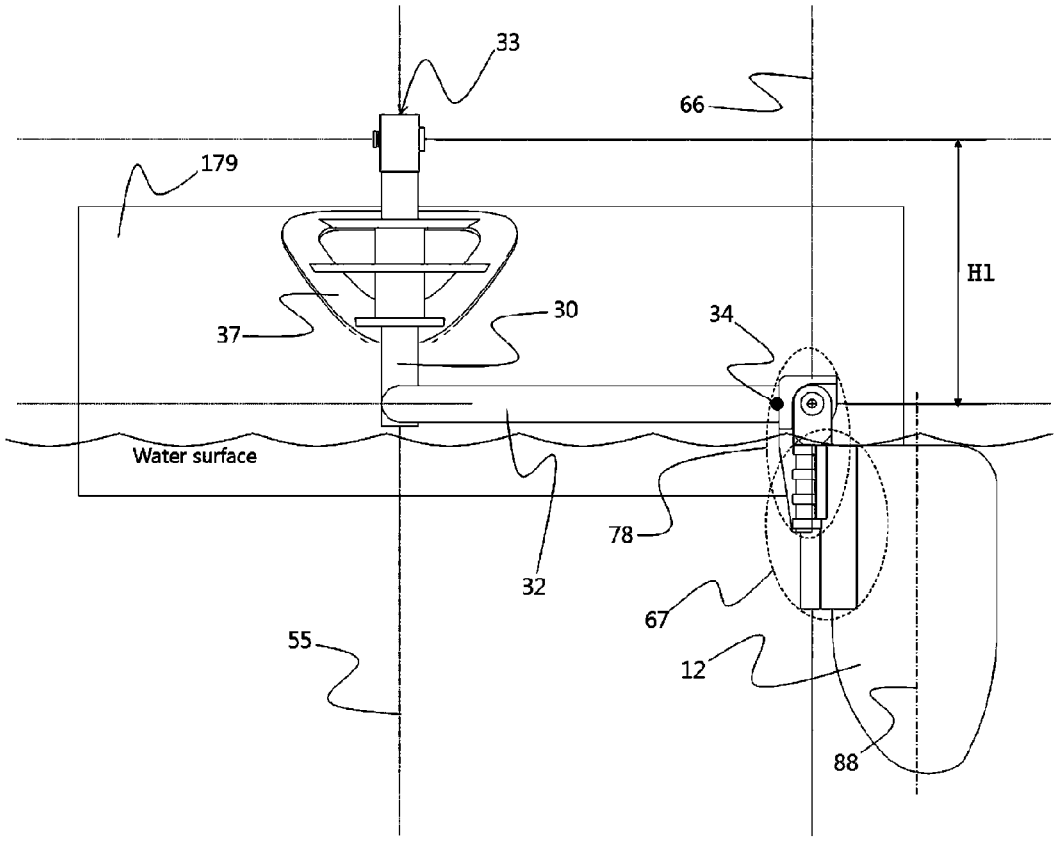

FIGS. 4A to 4C are views of the human-powered propulsion apparatus of FIG. 3A according to the first embodiment of the present invention. Only the propulsion apparatus 36 mounted on the left side of the boat body 179 and operated by a left hand of the rider and the mounting means 37 fixing the propulsion apparatus 36 to the boat body 179 are illustrated.

The mounting means 37 positioned on the side of the boat body 179 provides a first rotation axis 55 in a vertical direction to the propulsion apparatus 36 paired therewith.

The propulsion apparatus 36 includes a rotational post 30 fixed in position by the mounting means 37 to rotate about the first rotation axis 55, a handle crank 31 having a predetermined length and placed in a width direction of the boat body 179 so that an outer end thereof is coupled to an upper portion of the rotational post 30, an oscillating crank 32 having a predetermined length and placed in a longitudinal direction of the boat body 179 so that a front end thereof is coupled to the rotational post 30, and a plate-shaped foil 12 having a predetermined length and width and coupled to a rear end of the oscillating crank 32 in a longitudinal direction of the boat body 179. When the rider grasps the handle crank 31 and alternately move forward and backward, the foil 12 oscillates about the first rotation axis 55 to generate propulsion force.

Referring to the plan view of FIG. 4B, when the position of the first rotation axis 55 is expressed as the first pivot 11, a ratio W1/L2 of a straight-line distance W1 from the first pivot 11 to an end of the oscillating crank 32 in a width direction of the boat body 179 to a straight-line distance L2 from the first pivot 11 to an end 34 of the oscillating crank 32 in a longitudinal direction of the boat body 179 may has an arc tangent value of 5 degrees or more. According to the geometry, a sufficient motion range 221 in which the foil 12 oscillates in the left and right directions may be secured although the mounting means 37 is closely coupled to the side of the inflatable boat body 179.

Also, if the mounting means 37 is modified in shape like an outrigger so that the first pivot 11 is positioned more away from the boat body 179, the motion range of the foil 12 may increase without spreading a rear portion of the oscillating crank to the outside of the boat body 179.

Referring to the right side view of FIG. 4C, a rear end 34 of the oscillating crank 32 has a height less by a predetermined height H1 than that of an outer end 33 of the handle crank 31. This is done because the height at which the rider easily moves an arm is higher than the water surface.

Also, the rear end 34 of the oscillating crank 32 may be positioned higher than the lowest portion of the boat body 179. This is intended to reduce the propulsion resistance during the operation by minimizing the portion of the oscillating crank 32, which is submerged under the water surface.

In addition, in the structure in which the oscillating crank 32 and the foil 12 are coupled to each other, a flapping hinge 67 having a rotation axis 66 in a vertical direction is coupled to the rear end of the oscillating crank 32, and then, the foil 12 is coupled to the flapping hinge 67 in a longitudinal direction of the boat body 179.

Thus, since the foil 12 horizontally rotates at a predetermined angle θ about the rotation axis 66 provided by the flapping hinge 67, the foil 12 has a specific pitch in generating propulsion force, like a propeller. Here, the rotation axis 66 provided by the flapping hinge 67 may be the same as the rotation axis provided by the second pivot 13, which is illustrated in FIGS. 1, 2A, 2C, and 4B.

According to the above-described technical knowledge of the oscillating foil, as illustrated in FIG. 4C, it is preferable that the foil 12 has a shape that is vertically elongated on the whole, so that the foil 12 has a height greater than a length thereof, Also, it is preferable that a rear portion of the foil 12 is more flexible than a front portion of the foil 12 when a side surface of the foil 12 is divided into two front and rear portions by using a virtual vertical center line 88.

The human-powered propulsion apparatus according to the first embodiment of the present invention will be more particularly described with reference to exploded views and operations illustrated in FIGS. 5A to 5G.

Figure 5A:
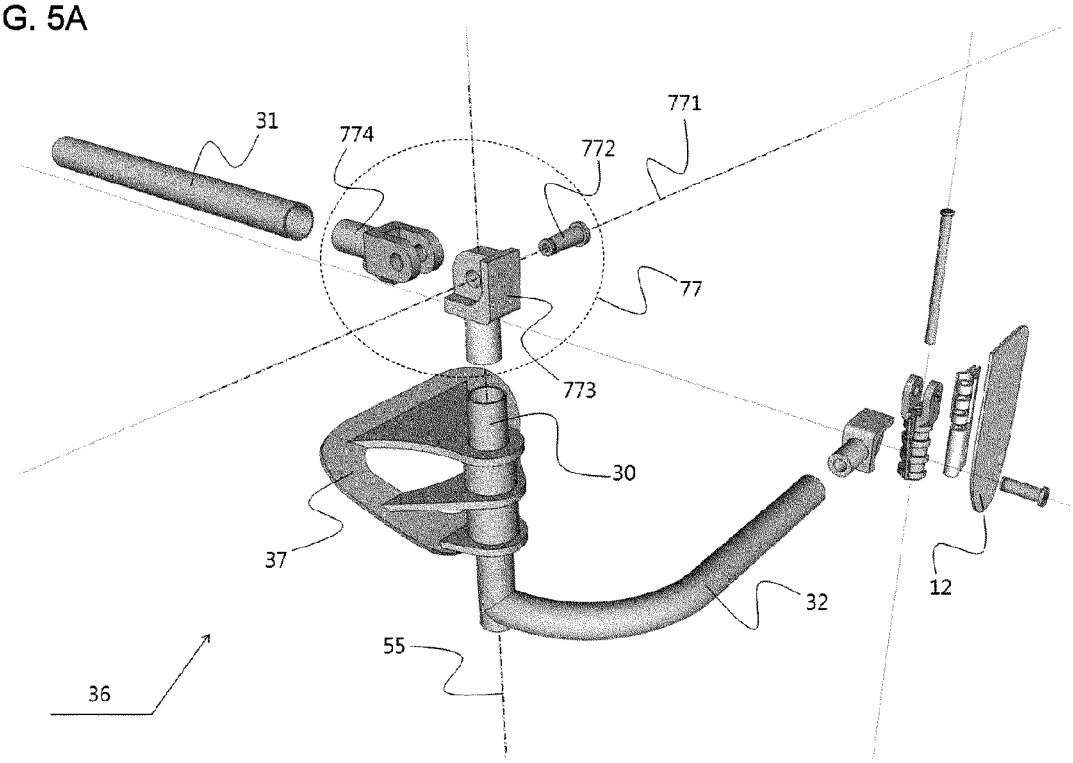
FIGS. 5A to 5G are views illustrating a configuration and operation of the human-powered propulsion apparatus of FIG. 4A.

Referring to the exploded view of FIG. 5A, in the propulsion apparatus 36 having the structure in which the rotational post 30 and the handle crank 31 are coupled to each other, a motion hinge 77 having a rotation axis 771 in a longitudinal direction of the boat body 179 is coupled to an upper portion of the rotational post 30, and an outer end of the handle crank 31 is coupled to the motion hinge 77 in a width direction of the boat body 179.

Figure 5B:
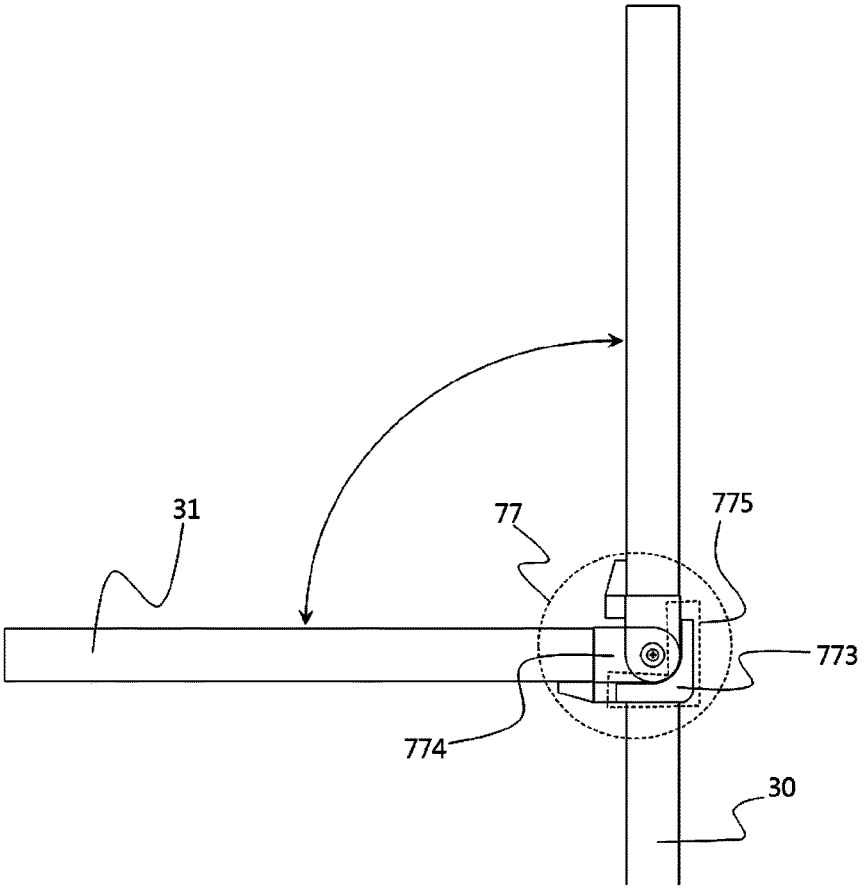

Thus, as illustrated in the front view of FIG. 5B, the handle crank 31 may oscillate at a predetermined angle about the rotation axis provided by the motion hinge 77. As a result, when the rider grasps and rows the handle crank 31, an upward and downward motion may be added to a forward and backward motion to allow the rider's hand moves along an oval path at if the rider rows a general oar. However, although the rider's arm movement is free as described above, the motion transmitted to the oscillating crank 32 in FIG. 5A may be only the oscillation about the first rotation axis 55.

Particularly, the motion hinge 77 may be provided by coupling a first coupling element 774 coupled to the handle crank 31 to a second coupling element 773 coupled to the rotational post 30 by inserting a hinge pin 772 having a rotation axis 771 in a longitudinal direction of the boat body 179.

As illustrated in FIG. 5B, it is preferable that the vertical oscillating motion range of the handle crank 31 is limited from a horizontal line to a vertical line. This may be easily realized by forming an L-shaped hooking portion 775 in the second coupling element 773.

Figure 5C:
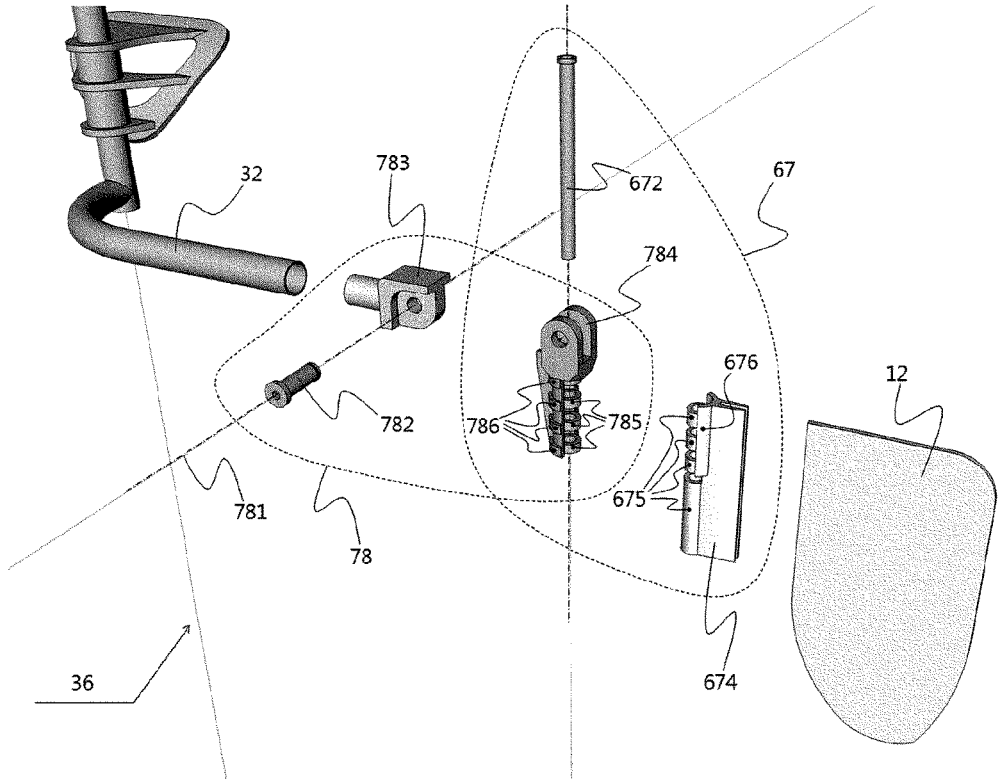

Referring to the exploded view of FIG. 5C, in the propulsion apparatus 36 having the structure in which the oscillating crank 32 and the foil 12 are coupled to each other, a retracting hinge 78 having a rotation axis 781 in a width direction of the boat body 179 is coupled to the rear portion of the oscillating crank 32, and the foil 12 is coupled to the retracting hinge 78 in a longitudinal direction of the boat body 179.

Figure 5D:
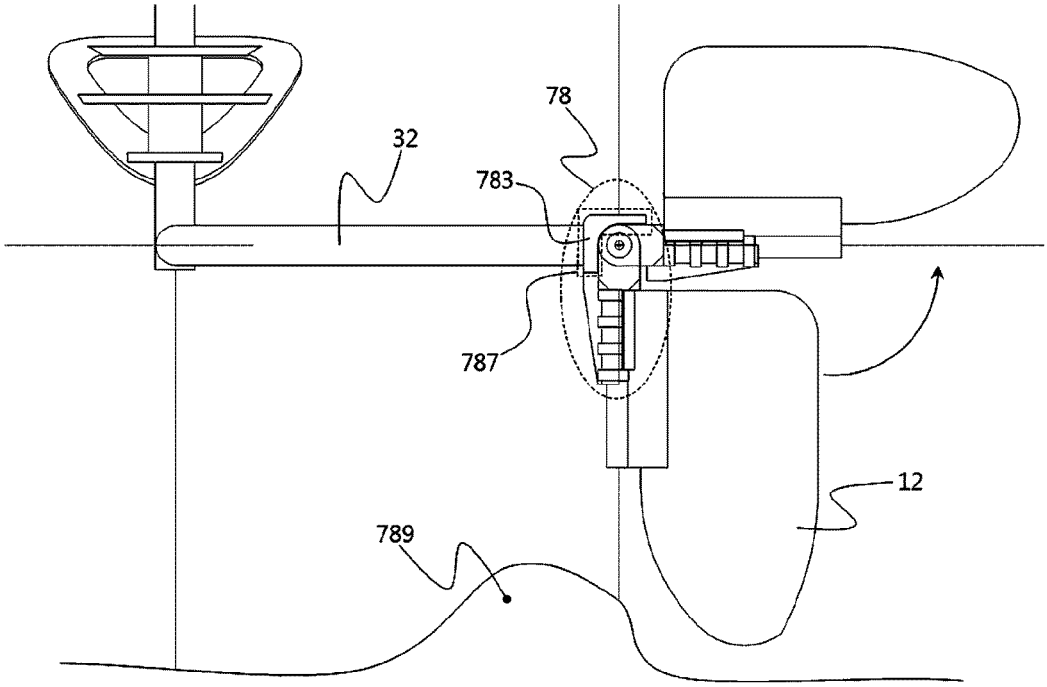
Figure 5E:
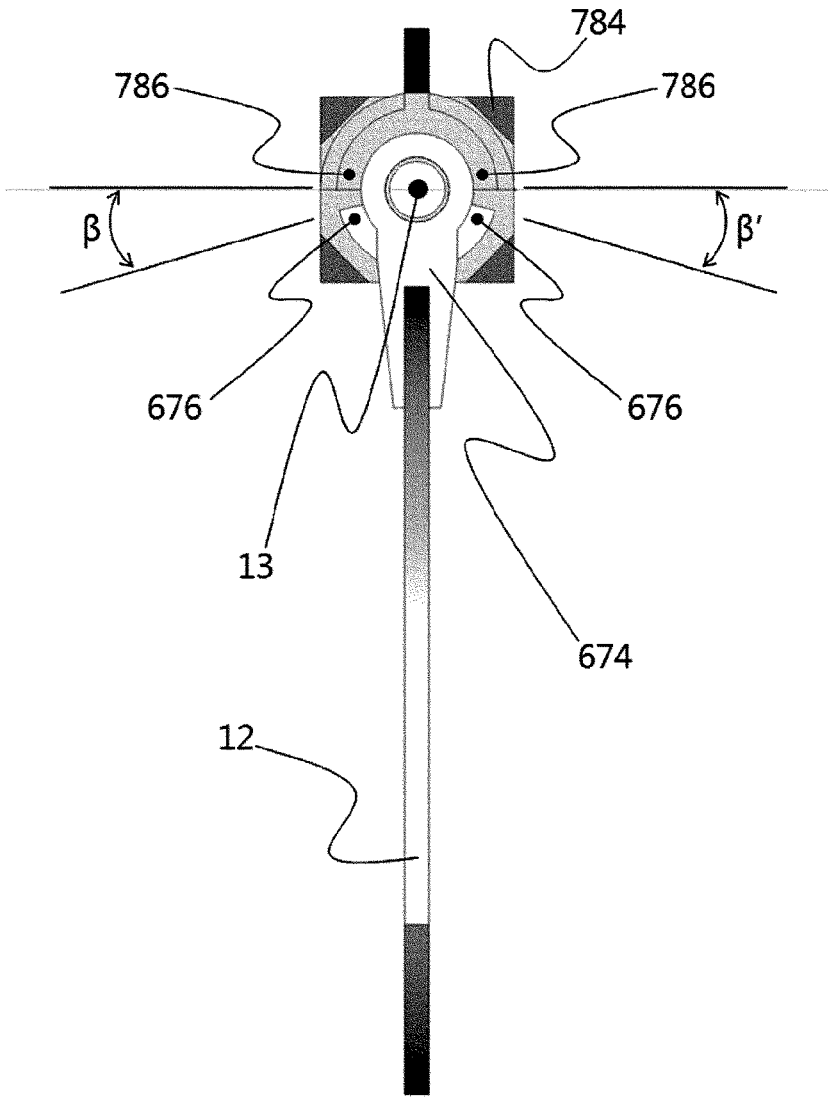
Figure 5F:
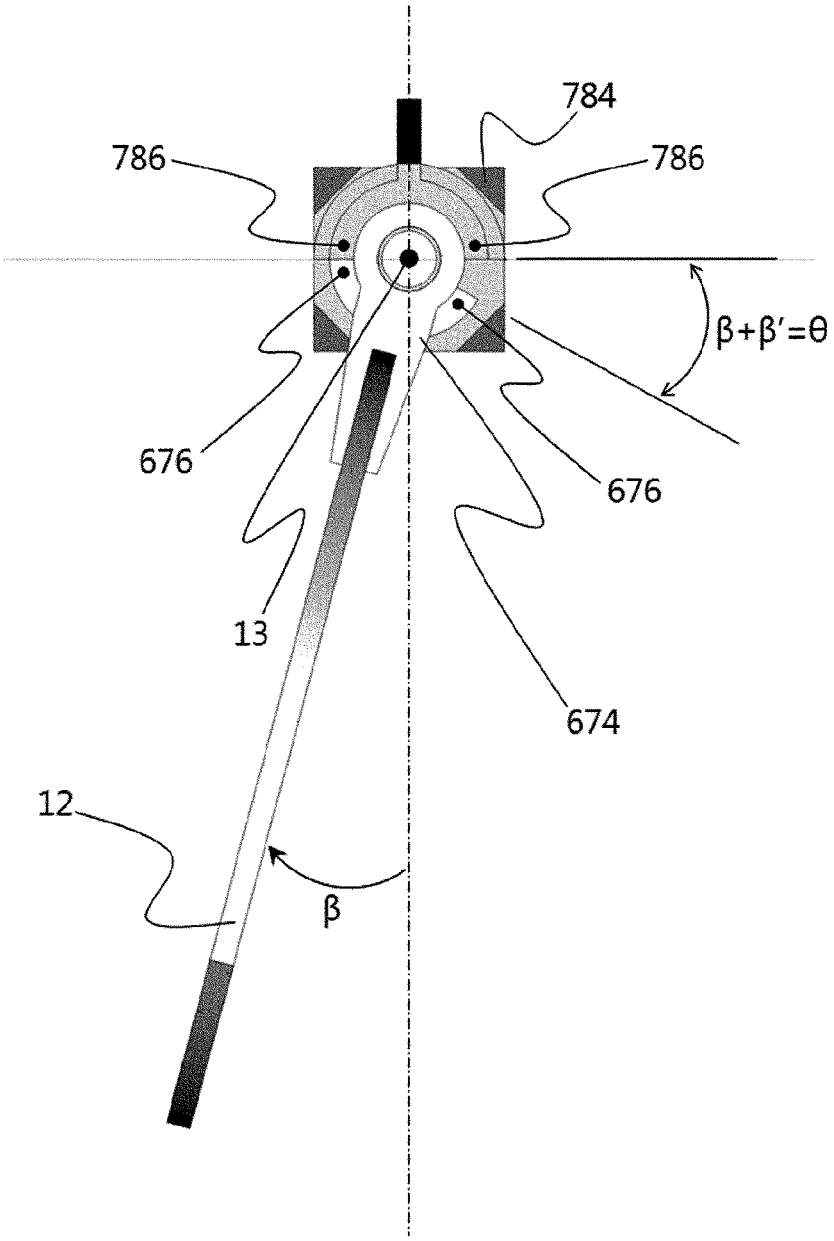

Thus, as the right side view illustrated in FIG. 5D, when the foil 12 collides with an underwater obstacle 789, the foil 12 may rotate at a predetermined angle about the rotation axis provided by the retracting hinge 78 and be lifted upward to reduce the risk of damage. Here, it is preferable that the vertical oscillating motion range of the foil 12 is limited from a vertical line to horizontal line. This may be easily realized by forming an L-shaped hooking portion 783 in a third coupling element.

As described above, it is seen that two hinges such as the flapping hinge 67 and the retracting hinge 78 may be added when the oscillating crank 32 and the foil 12 of the human-powered propulsion apparatus are coupled to each other. Explaining a specific configuration, in which the two hinges are added at once, with reference to FIG. 5C, a third coupling element 783 is coupled to the rear end of the oscillating crank 32, and then, a fourth coupling element 784 is coupled by using a horizontal hinge pin 782 to constitute the retracting hinge 78.

Subsequently, a fifth coupling element 674 is coupled to a rear portion of the fourth coupling element 784 by using a vertical hinge pin 672 to constitute the flapping hinge 67. The foil 12 is coupled to a rear portion of the fifth coupling element 674 in a longitudinal direction of the boat body 179.

Here, the fourth coupling element 784 includes at least one or more rings 785 that are spaced away at a predetermined distance from each other along the second rotation axis 66 provided by the vertical hinge pin 672, and the fifth coupling element 674 includes at least one or more rings 675 that are disposed to miss the rings of the fourth coupling element. Thus, when the fourth coupling element 784 and the fifth coupling element 674 are coupled to each other, the rings 786 and 675 respectively provided at the elements may be engaged with each other like gears and then strung downward from top to bottom in a line by using the vertical hinge pin 672 and fixed in position.

In the coupling structure as described above, two hinge's function may be realized at the same time with small number of components. Also, since it is impossible to disassemble the flapping hinge 67 without withdrawing the hinge pin 782 constituting the retracting hinge 78, the flapping hinge 67 that has to endure vibrations may be improved in durability.

Here, at least one stopping protrusion 786 is disposed on each of left and right sides of the fourth coupling element 784, and at least one stopping protrusion 676 is disposed on each of left and right sides of the fifth coupling element 674. Since the stopping protrusions 786 and 676 are positioned at the same height when being coupled, if the foil 12 starts to rotate in one direction from the idle state illustrated in FIG. 5E (a rear view) with respect to the oscillating crank 32, the rotation stops when the stopping protrusions 786 and 676 meet together, so that the maximum rotation range of the fin is defined.

Figure 5G:
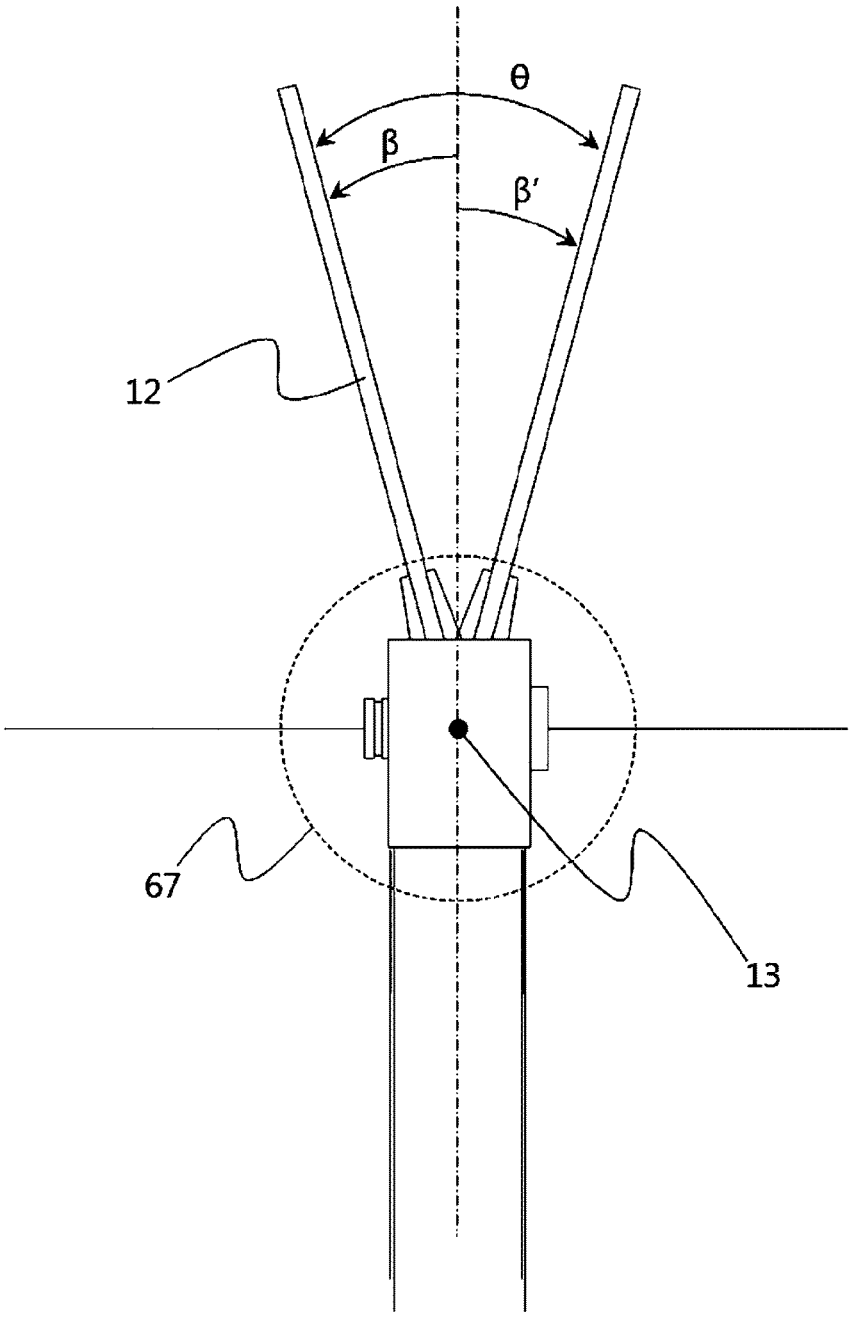

The oscillation of the foil 12 with respect to the oscillating crank 32 is illustrated in the top plan view of FIG. 5G. Here, the second rotation axis 66 provided by the flapping hinge 67 may be the same as the second pivot 13 on the drawing.

Angles β and β' at which the foil rotates in a left or right direction with respect to the idle state may be different from each other. In this case, it is preferable that the internal angle positioned closer to the boat body 179 is greater than another angle (β>β').

In the human-powered propulsion apparatus according to the first embodiment of the present invention, since the oscillating crank 32 is coupled to a lower portion of the rotational post 30, it is difficult to detach or mount the propulsion apparatus 36 from or to the mounting means 37.

Figure 6A:
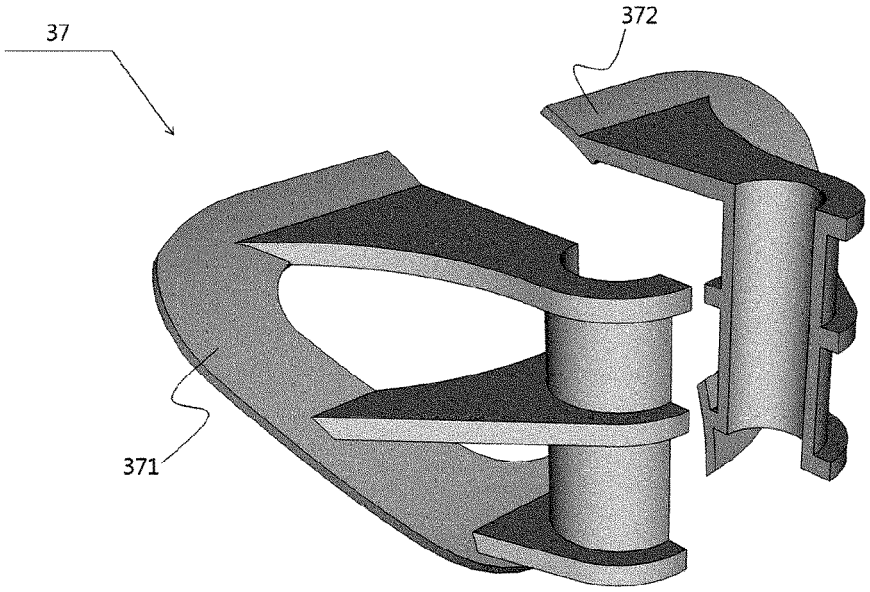
FIGS. 6A and 6B are views illustrating a configuration and operation of a mounting means of FIG. 3A.
Figure 6B:
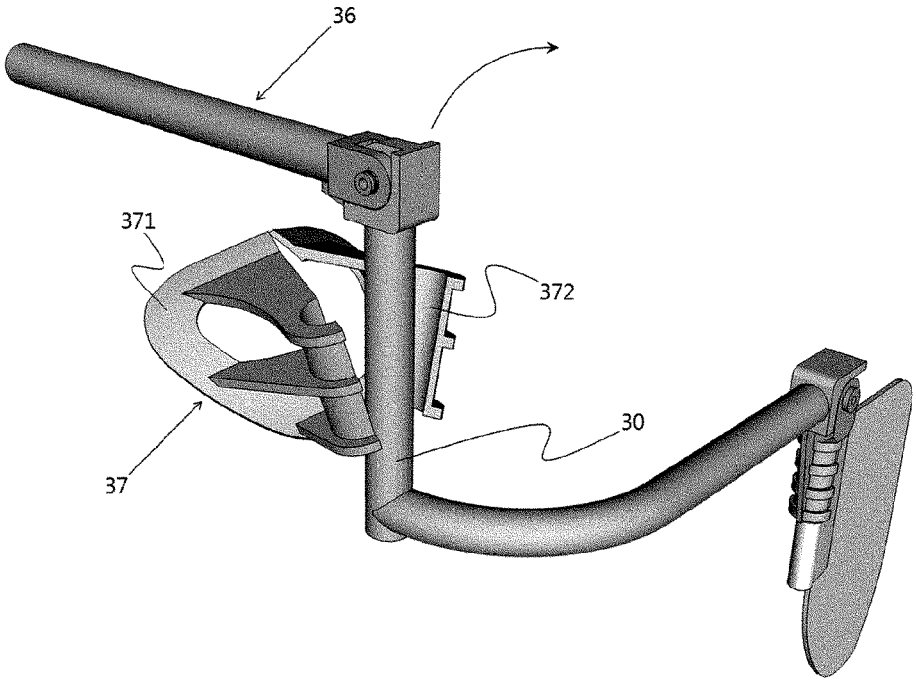

However, in case of that the boat body 179 is inflatable as described in the human-powered boat according to the first embodiment of the present invention, or a potion of the boat body 179, on which the mounting means is fixed, is provided as an inflatable float, if the mounting means 37 may be divided into at least two components 371 and 372 by using at least one vertical cross-section as illustrated in the perspective view of FIG. 6A, contact surfaces of at least two components constituting the mounting means 37 may be spread to easily detach the propulsion apparatus 36 from the mounting means 37 in a state in which air within the boat body 179 may be discharged to reduce an internal pressure as illustrated in FIG. 6B.

As described above, the vertically divided mounting means 37 may be manufactured through injection molding by using a simple mold and thus reduced in manufacturing costs.

In the human-powered boat according to the first embodiment of the present invention, the boat body is for a one-seater boat and two propulsion apparatuses 36 and 36' positioned bilaterally symmetrical to each other are mounted on the boat body. In case of a two or more-seater boat on which two or more persons may ride side by side at left and right sides, each of the propulsion apparatuses may be asymmetrically disposed on left and right sides one another. Thus, regarding the mounting of the propulsion apparatuses, the symmetrical feature of the propulsion apparatuses may be flexibly applicable.

In some cases, the present invention may include a structure in which only one propulsion apparatus is mounted on one side of the boat body 179, and the general oar is rowed at an opposite side.

Figure 7A:
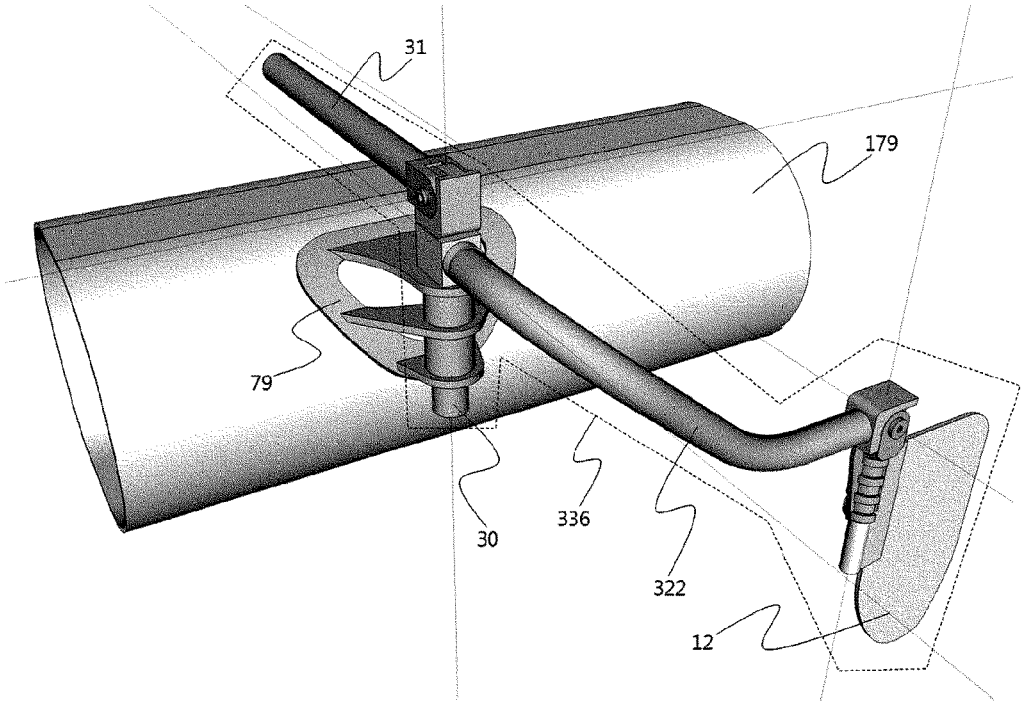
FIGS. 7A to 7E are views of a human-powered propulsion apparatus according to a second embodiment of the present invention.
Figure 7B:
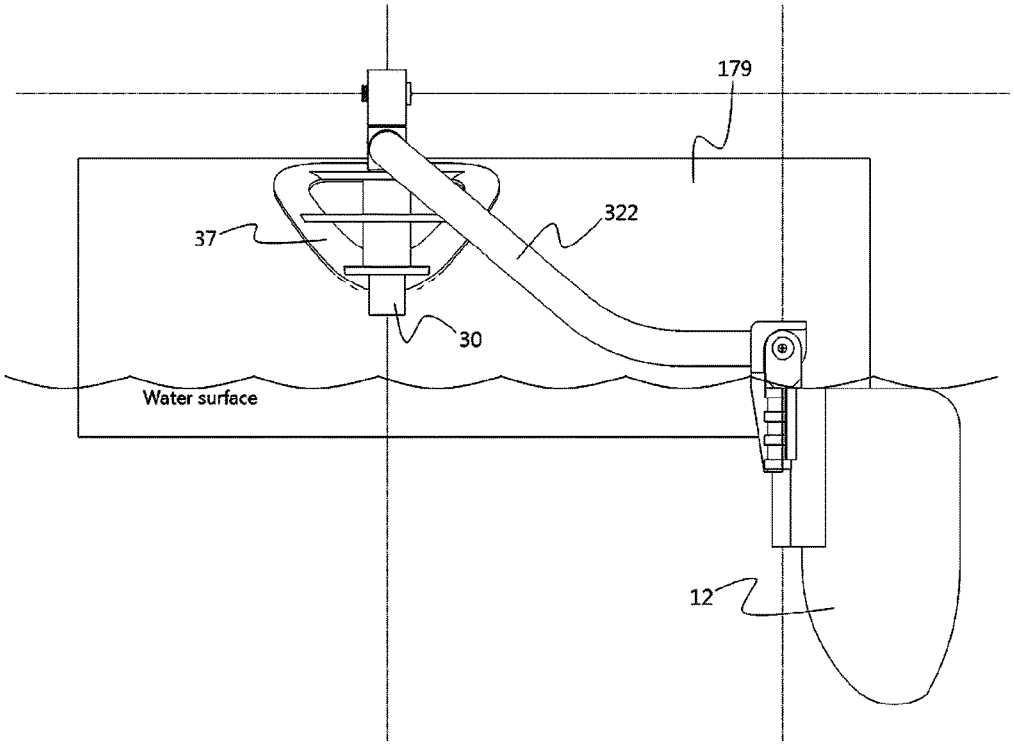

FIGS. 7A to 7E are views of a human-powered propulsion apparatus according to a second embodiment of the present invention. Referring to FIG. 7A, in a human-powered propulsion apparatus 336 according to a second embodiment of the present invention, it is confirmed that an oscillating crank 322 is coupled to an upper portion of a rotational post 30, unlike the propulsion apparatus 36 according to the foregoing first embodiment. Referring to FIG. 7B, the oscillating crank 322 gradually decreases in height from a portion thereof coupled to the rotational post 30 to a rear of a boat body 179 and then is coupled to a foil 12. A shape in which the oscillating crank 322 is inclined backward and downward may provide an effect in which energy loss is less because a portion of the oscillating crank 322, which is submerged under the water, is reduced even though the boat body 179 is deeply submerged under the water surface due to the large loadage.

Figure 7C:
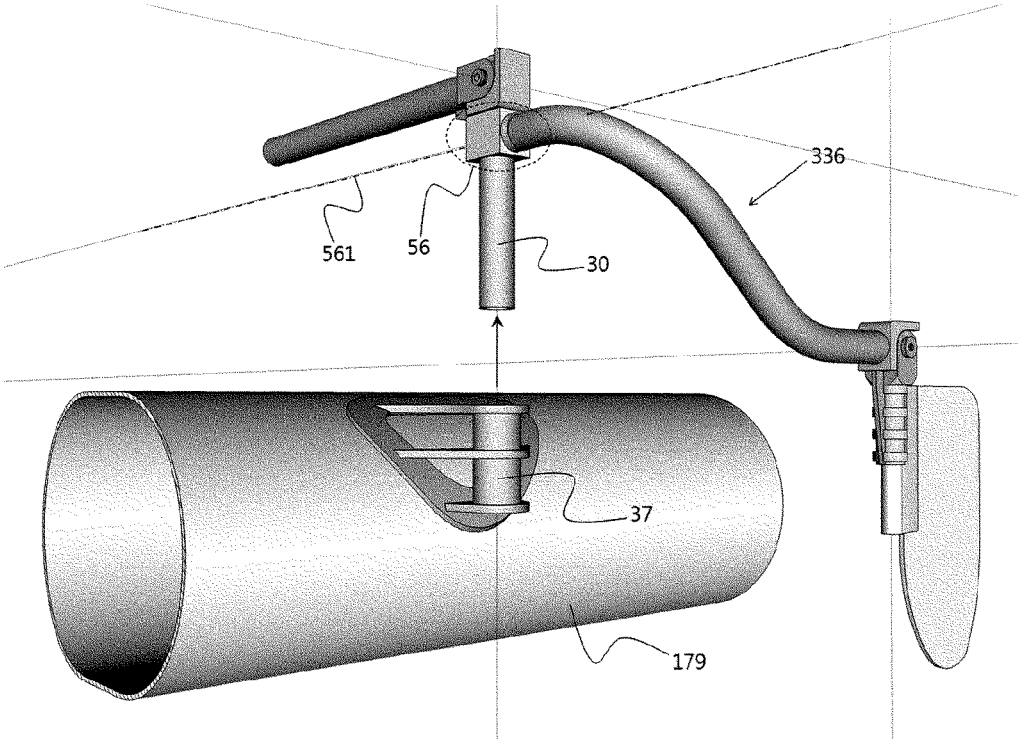

Also, the largest advantage of the propulsion apparatus 336 having the geometry is that the propulsion apparatus 336 may be easily lifted and detached from the boat body 179 as illustrated in FIG. 7C. Of course, even when being mounted again, the rotational post 30 may be simply inserted into the mounting means 37 to mount the propulsion apparatus 336 on the boat body 179.

Figure 7D:
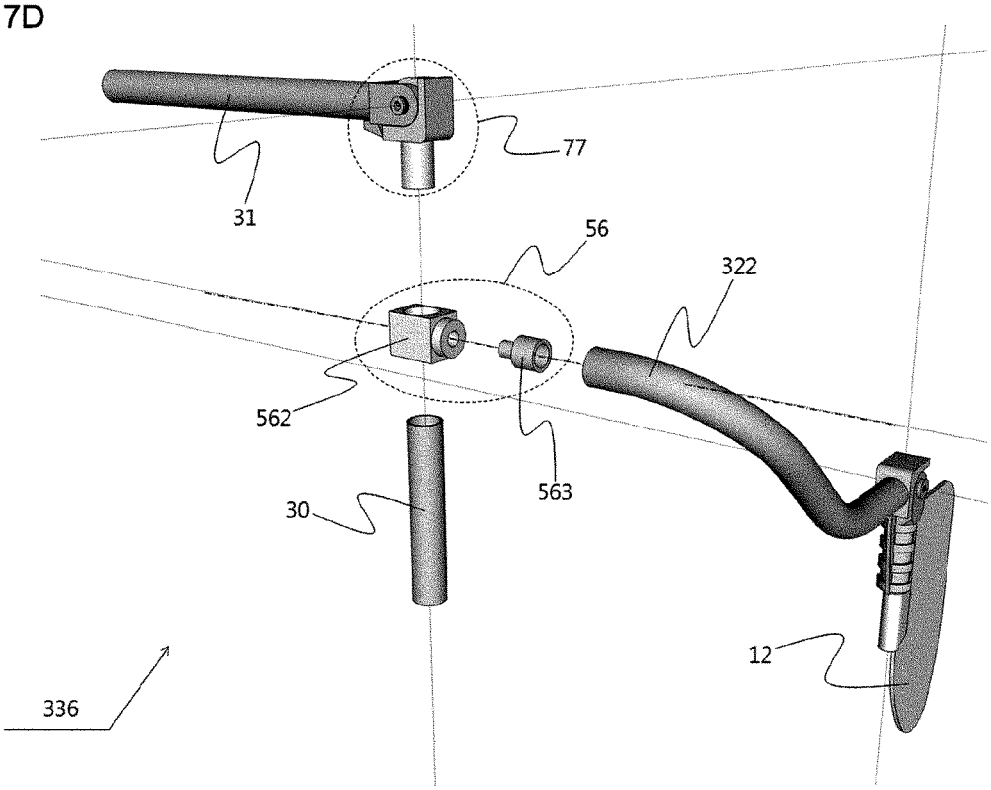

Furthermore, in the propulsion apparatus 336 having the structure in which the rotational post 30 and the oscillating crank 322 are coupled to each other, a folding hinge 56 having a rotation axis 561 in a width direction of the boat body 179 is added to the coupled portion between the rotational post 30 and the oscillating crank 322. Referring to FIG. 7D, the folding hinge 56 includes a sixth coupling element 562 coupled to the rotational post 30, and a seventh coupling element 563 inserted into the folding hinge 56 to rotate at a fixed angle about the rotation axis 561 in a width direction of the boat body 179 and coupled to a front end of the oscillating crank 322.

The sixth coupling element 562 and the seventh coupling element 563 do not have to be separated from each other during the operation of the propulsion apparatus 336 and have to provide a function that restricts the oscillating crank 322 so that the oscillating crank 322 stops to rotate downward at a specific angle. Since this is capable of being secured through a simple design change of the folding hinge 56, such as adding of a predetermined locking means operable by a rider's hand and a modification of contact surfaces of the two coupling elements 562 and 563 into uneven surfaces, its detailed description will be omitted in the present invention.

Due to the effect through the adding of the folding hinge 56, the propulsion apparatus 336 may be reduced in overall volume because the oscillating crank 322 rotates upward at a predetermined angle about the rotation axis 561 provided by the folding hinge 56 and then is lifted.

Figure 7E:
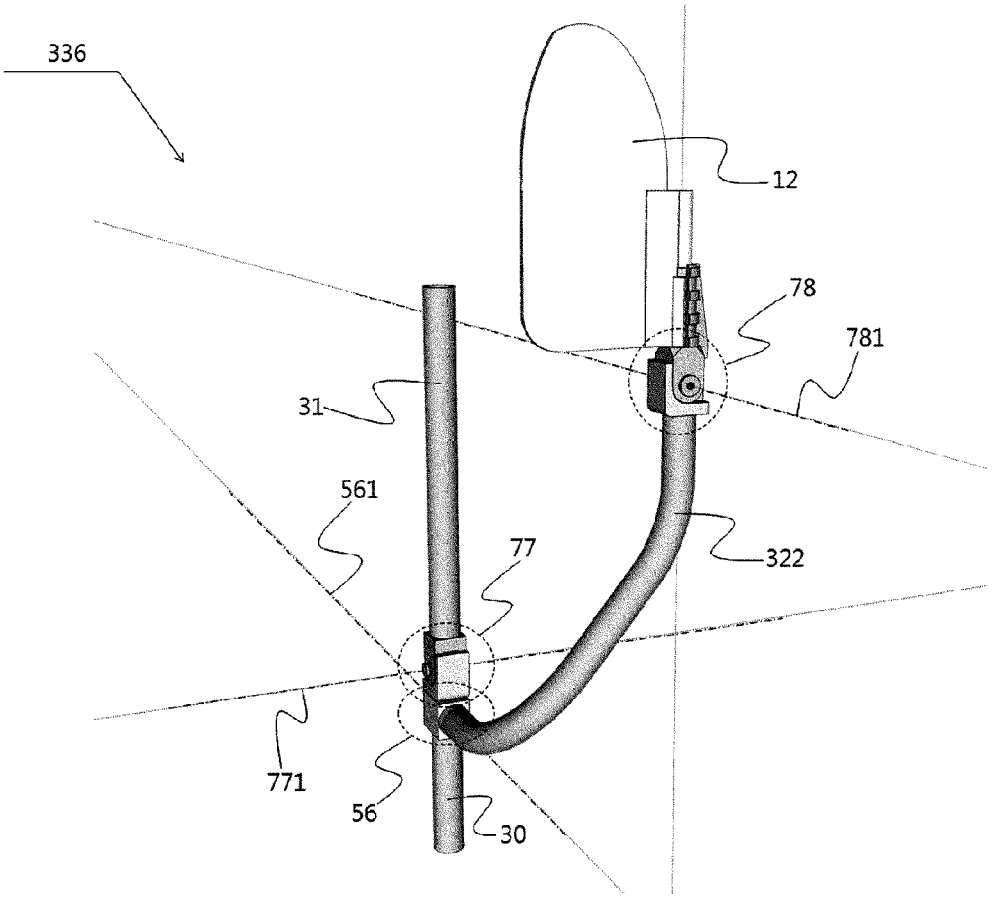

Referring to FIG. 7E, the propulsion apparatus 336 is detached from the boat body 179, and then, a handle crank 31 is folded upward with respect to a motion hinge 77. Then, the oscillating crank 322 is folded upward with respect to the folding hinge 56, and then, a foil 12 is folded upward with respect to a retracting hinge 78 to reduce the overall volume. Therefore, the propulsion apparatus 336 may be easily carried and stored.

Of cause, the folding hinge 56 provides the same effect when the folding hinge 56 is applied to the human-powered propulsion apparatus 36 according to the first embodiment.

The handle cranks 31 and 31' and the oscillating cranks 32, 32,' and 322 of the human-powered propulsion apparatus according to the present invention have to be changed in length according to the boat body 179 or a body size of the rider. For example, when the boat body 179 increases in width thereby increasing a distance from the rider's position to the mounting means, it is necessary to increase a length of each of the handle cranks 31 and 31'. Also, the increase in length of each of the oscillating cranks 32, 32' and 322 may be effective as a method for expanding the motion range of each of the foils 12 and 12'.

Thus, in the human-powered propulsion apparatus according to a third embodiment of the present invention, each of the handle cranks 31 and 31' or the oscillating cranks 32, 32' and 322 may have a telescopic tube structure that is adjustable in length. Since this structure is commonly found from an umbrella to a smartphone antenna, the structure will be omitted in the drawings.

However, the telescope tube structure may include a stopping means for fixing the telescopic tube such after a length of the telescope tube is adjusted as a screw. Or, a constituent for remotely adjusting a length of each of the oscillating cranks 32, 32' and 322 by using a string may be added. Since these constituents are commonly adopted to operate a sail or rudder in the small-sized boat technical fields, their detailed descriptions will be omitted.

The human-powered boat according to the second embodiment of the present invention may represent a human-powered boat in which the human-powered propulsion apparatus according to the second embodiment is mounted on the boat body 179 of the human-powered boat according to the first embodiment. Similarly, the human-powered boat according to the third embodiment of the present invention may represent a human-powered boat in which the human-powered propulsion apparatus according to the third embodiment is mounted on the boat body 179 of the human-powered boat according to the first embodiment. Thus, drawings with respect to the human-powered boats according to the second and third embodiments will be omitted.

Various features according to each of the embodiments of the present invention may be mutually applied to each other. For example, the telescope tube structure of the human-powered propulsion apparatus according to the third embodiment may be applied to the handle crank of the human-powered propulsion apparatus according to the second embodiment, and the folding hinge of the human-powered propulsion apparatus according to the second embodiment may be applied to the human-powered boat according to the first embodiment. Also, the structure in which the mounting means of the human-powered boat according to the first embodiment is divided into at least two components may be applied to the human-powered boat according to the second or third embodiment.

INDUSTRIAL APPLICABILITY

The present invention relates to the non-motorized movable human-powered boat and the human-powered propulsion apparatus thereof. Particularly, the present invention may be applied to the structure in which the rider rows the oar through the forward and backward movement of the rider's arm while facing the advancing direction of the boat.

The invention claimed is:

1. A boat comprising:

a boat body having a longitudinal axis connecting a middle of a front end and a rear end of the boat body;

at least one mounting connector disposed on at least one side of the boat body;

at least one propulsion apparatus coupled to the mounting connector comprising a handle crank, a rotational post, an oscillating crank, and a foil, wherein the at least one propulsion apparatus in an idle state comprises the handle crank oriented in a width direction of the boat body, the rotational post oriented in a height direction of the boat body, and the oscillating crank oriented in a longitudinal direction of the boat body, wherein an outer end of the handle crank is coupled to the rotational post, the rotational post is coupled to a front end of the oscillating crank, and the rotational post is rotatably coupled to the mounting connector, and a rolling motion of the oscillating crank is limited by the rotational post having one degree of freedom with respect to the mounting connector and the front end of the oscillating crank is positioned higher than the water surface, and wherein when the propulsion apparatus is in a working state, an imaginary line passing through the front end and a rear end of the oscillating crank does not meet the longitudinal axis in a plan view within an area between the rotational post and the rear end of the boat body; and the foil extended in a vertical plane and rotatably coupled to a rear end of the oscillating crank via a first pivot joint, wherein the first pivot joint allows the foil to rotate around a vertical axis within a predetermined angle.

2. The boat of claim 1, wherein the rotational post is detachably coupled to the mounting connector.

3. The boat of claim 1, wherein the rear end of the oscillating crank has a predetermined distance (W) from the rotational post in the width direction of the boat body.

4. The boat of claim 3, wherein a longitudinal distance (D) between the rotational post and the rear end of the oscillating crank in the longitudinal direction of the boat body, and the predetermined distance (W) meet the following equation: $\arctan(W/D) \geq 5°$.

5. The boat of claim 1, wherein the handle crank is rotatably coupled to the rotational post via a second pivot joint and has a pivotal movement in up-and-down with respect to the rotational post.

6. The boat of claim 5, wherein the second pivot joint has a rotation axis in the longitudinal direction of the boat body and is coupled to an upper end of the rotational post, and the outer end of the handle crank is coupled to the second pivot joint in the width direction of the boat body, and wherein the handle crank is pivotally rotatable around the rotation axis of the second pivot joint at a predetermined angle.

7. The boat of claim 6, wherein the second pivot joint comprises a first coupling member, a second coupling member, and a hinge pin, wherein the hinge pin, having a rotation axis in the longitudinal direction of the boat body, pivotally connects the first coupling member to the second coupling member, and wherein the first coupling member is coupled to the handle crank and the second coupling member is coupled to the rotational post.

8. The boat of claim 1, wherein the foil is rotatably coupled to the oscillating crank via the first pivot joint and has two pivotal movements in left-and-right and up-and-down direction.

9. The boat of claim 8, wherein the first pivot joint has two rotation axes in the height direction and the width direction of the boat body and is coupled to the rear end of the oscillating crank, and wherein the foil is coupled to the first pivot joint in the longitudinal direction of the boat body, and the foil rotates at a predetermined angle around one of the rotation axes to flap in left-and-right direction and rotates at a predetermined angle around the other of the rotation axes to be lifted upward in a case of a collision with underwater obstacle.

10. The boat of claim 9, wherein the first pivot joint comprises:

a retracting hinge having, a third coupling member coupled to the rear end of the oscillating crank, and a fourth coupling member coupled to the third coupling member by using a horizontal hinge pin; and a flapping hinge having, a fifth coupling member coupled to the fourth coupling member by using a vertical hinge pin, wherein the foil is coupled to the fifth coupling member, wherein the fourth coupling member includes at least one first ring, and the fifth coupling member includes at least one second ring, and wherein the at least one first ring and the at least one second ring are disposed to be engaged in one another.

11. The boat of claim 1, wherein the foil is elongated downward having a height greater than a length.

12. The boat of claim 1, wherein the foil has a front portion and a rear portion, and a flexibility of the rear portion is higher than that of the front portion.

13. The boat of claim 1, wherein the propulsion apparatus further comprises a folding hinge having a rotation axis in a width direction of the boat body on a portion at which the rotational post and the oscillating crank are coupled to each other, and wherein when the propulsion apparatus is detached from the boat body, the oscillating crank is lifted upward at a predetermined angle with respect to the rotation axis of the folding hinge.

14. The boat of claim 1, wherein the propulsion apparatus comprises a length-adjustable telescopic tube structure for at least one of the handle crank and the oscillating crank.

15. The boat of claim 1, wherein the boat body comprises an inflatable float on at least one side of the boat body or the boat body is comprised of an inflatable material.

16. The boat of claim 1, wherein the boat comprises a pair of the propulsion apparatuses.

17. A propulsion apparatus comprising, in combination with a boat:

a boat body having a width and a length and a longitudinal axis connecting a middle of a front end and a rear end of the boat body; and at least two propulsion apparatuses located one on each side of the boat body, wherein each of the propulsion apparatuses in an idle state comprises:

an L-shaped oar including two looms coupled together and forming an elbow, wherein one of the looms constitutes a handle crank lying generally widthways and the other of the looms constitutes an oscillating crank lying generally lengthways, and the elbow is detachably coupled to the boat body via a first pivot joint mounted on a side of the boat body and has a pivotal movement on a horizontal plane, wherein a rolling motion of the oscillating crank is limited by the elbow having one degree of freedom with respect to the boat body and the front end of the oscillating crank is positioned higher than the water surface; and a flapping foil rotatably coupled to a rear end of the oscillating crank via a second pivot joint, wherein the second pivot joint allows the flapping foil to rotate around a vertical axis within a predetermined angle.

18. The propulsion apparatus of claim 17, wherein the handle crank is rotatably coupled to the oscillating crank via a third pivot joint at the elbow and has a pivotal movement in up-and-down with respect to the oscillating crank.

19. The propulsion apparatus of claim 17, wherein the foil is rotatably coupled to the oscillating crank via the second pivot joint and has two pivotal movements in left-and-right and up-and-down direction with respect to the oscillating crank.

20. The propulsion apparatus of claim 17, wherein an imaginary line passing through a front end and a rear end of the oscillating crank forms an angle against the longitudinal axis, and the angle is equal to or larger than 5 degrees outside from the longitudinal axis.

* * * * *